US010491984B2

(12) United States Patent
Honda et al.

(10) Patent No.: US 10,491,984 B2
(45) Date of Patent: Nov. 26, 2019

(54) SPEAKER DEVICE

(71) Applicant: Panasonic Intellectual Property Management Co., Ltd., Osaka (JP)

(72) Inventors: Kazuki Honda, Osaka (JP); Takafumi Yuasa, Osaka (JP); Akihisa Kawamura, Osaka (JP); Toshiyuki Matsumura, Osaka (JP); Shuji Saiki, Nara (JP); Satoshi Takayama, Mie (JP); Suemei Fukuhara, Osaka (JP); Isao Kuramitsu, Osaka (JP); Ippei Kiyama, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/753,258

(22) PCT Filed: Aug. 8, 2016

(86) PCT No.: PCT/JP2016/003642
§ 371 (c)(1),
(2) Date: Feb. 17, 2018

(87) PCT Pub. No.: WO2017/038016
PCT Pub. Date: Mar. 9, 2017

(65) Prior Publication Data

US 2018/0242061 A1 Aug. 23, 2018

(30) Foreign Application Priority Data

Sep. 1, 2015 (JP) ..... 2015-172384
Mar. 10, 2016 (JP) ..... 2016-047675

(51) Int. Cl.
*H04R 1/22* (2006.01)
*H04R 1/28* (2006.01)
(Continued)

(52) U.S. Cl.
CPC ..... *H04R 1/227* (2013.01); *H04R 1/2826* (2013.01); *H04R 3/04* (2013.01); *H04R 1/30* (2013.01); *H04R 2499/10* (2013.01)

(58) Field of Classification Search
CPC ..... H04R 1/02; H04R 1/227; H04R 1/2826; H04R 1/2823; H04R 1/2857; H04R 1/30;
(Continued)

(56) References Cited

U.S. PATENT DOCUMENTS 2,544,742 A 3/1951 Volf
4,348,549 A * 9/1982 Berlant ..... H04R 1/26 181/152
(Continued)

FOREIGN PATENT DOCUMENTS

FR 705640 A 6/1931
JP 53-006422 Y 2/1978
(Continued)

OTHER PUBLICATIONS

International Search Report of PCT application No. PCT/JP2016/003642 dated Oct. 25, 2016.
(Continued)

*Primary Examiner* — Jesse A Elbin
(74) *Attorney, Agent, or Firm* — McDermott Will & Emery LLP

(57) ABSTRACT

Provided is a loudspeaker device that can improve sound quality. The loudspeaker device includes: a loudspeaker housing; a first loudspeaker unit provided in a first wall of the loudspeaker housing; and an acoustic tube communicating an inside and an outside of the loudspeaker housing to each other. The acoustic tube has a predetermined length, and is accommodated in the loudspeaker housing and is helically shaped.

9 Claims, 16 Drawing Sheets

(51) Int. Cl.
*H04R 3/04* (2006.01)
*H04R 1/30* (2006.01)

(58) Field of Classification Search
CPC . H04R 1/34; H04R 1/345; H04R 3/04; H04R 2499/10
USPC ..... 381/337, 338, 339, 349, 352, 160
See application file for complete search history.

(56) References Cited

U.S. PATENT DOCUMENTS

| | | | | | |
|---|---|---|---|---|---|
| 4,503,553 | A | | 3/1985 | Davis | |
| 4,503,554 | A | | 3/1985 | Davis | |
| 4,790,408 | A | | 12/1988 | Adair | |
| 5,131,052 | A | * | 7/1992 | Hill | H04R 1/2819 181/175 |
| 5,187,333 | A | | 2/1993 | Adair | |
| 5,821,471 | A | * | 10/1998 | McCuller | H04M 1/035 181/156 |
| 5,824,969 | A | * | 10/1998 | Takenaka | H04R 1/2857 181/156 |
| 6,712,177 | B2 | | 3/2004 | Ureda | |
| 7,051,835 | B2 | * | 5/2006 | Martikainen | H04R 1/2826 181/153 |
| 7,837,006 | B1 | | 11/2010 | Graber | |
| 9,286,863 | B2 | | 3/2016 | Moon | |
| 9,414,151 | B2 | * | 8/2016 | Kano | H04R 1/2857 |
| 2005/0117766 | A1 | | 6/2005 | Ito et al. | |
| 2008/0298623 | A1 | * | 12/2008 | Klein | H04R 1/2857 381/380 |
| 2011/0002468 | A1 | | 1/2011 | Tanghe | |

FOREIGN PATENT DOCUMENTS

| | | | |
|---|---|---|---|
| JP | 57-131083 | U | 8/1982 |
| JP | 03-196796 | A | 8/1991 |
| JP | 10-262296 | | 9/1998 |
| JP | 2005-159412 | | 6/2005 |
| JP | 2011-515926 | A | 5/2011 |
| JP | 2014-049999 | | 3/2014 |
| JP | 2014-049999 | A | 3/2014 |
| WO | 2009/112980 | A1 | 9/2009 |

OTHER PUBLICATIONS

International Search Report of PCT application No. PCT/JP2016/003643 dated Oct. 25, 2016; with English translation.
Invitation pursuant to Rule 63(1) EPC dated Aug. 14, 2018 for the related European Patent Application No. 16841057.9.
The Extended European Search Report dated Aug. 21, 2018 for the related European Patent Application No. 16841058.7.
Communication pursuant to Rule 164(1) EPC dated Oct. 26, 2018 for the related European Patent Application No. 16841057.9.
Non-Final Office Action issued in U.S. Appl. No. 15/753,259, dated Dec. 28, 2018.

* cited by examiner

SPEAKER DEVICE

This application is a U.S. national stage application of the PCT International Application No. PCT/JP2016/003642 filed on Aug. 8, 2016, which claims the benefit of foreign priority of Japanese patent applications No. 2015-172384 filed on Sep. 1, 2015 and No. 2016-047675 filed on Mar. 10, 2016, the contents all of which are incorporated herein by reference.

DESCRIPTION

Technical Field

The present disclosure relates to a loudspeaker device.

Background Art

Patent Literature (PTL) 1 discloses a bass reflex type loudspeaker device. The loudspeaker device disclosed in PTL 1 includes an enclosure, a loudspeaker unit, and a duct. The loudspeaker unit is disposed in and mounted on the enclosure. The duct is disposed in the enclosure to communicate between the inside and outside of the enclosure for ventilation. In the loudspeaker device, air in the duct resonates in the case that the loudspeaker unit vibrates at a predetermined low frequency. Therefore, in the loudspeaker device, sound output increases at the low frequency.

CITATION LIST

Patent Literature

PTL 1: Unexamined Japanese Patent Publication No. 2014-049999

SUMMARY

The present disclosure provides a loudspeaker device that can improve sound quality.

A loudspeaker device according to the present disclosure includes: a loudspeaker housing; a first loudspeaker unit provided in a first wall of the loudspeaker housing; and an acoustic tube communicating an inside and an outside of the loudspeaker housing to each other. The acoustic tube has a predetermined length, and is accommodated in the loudspeaker housing while helically bent.

The sound quality can be improved in the loudspeaker device of the present disclosure.

DESCRIPTION OF EMBODIMENTS

Hereinafter, exemplary embodiments will be described in detail with reference to the drawings as needed. However, the unnecessarily detailed description is occasionally omitted. For example, the detailed description of the already well-known item and the overlapping description of the substantially same configuration are occasionally omitted. This is because unnecessary redundancy of the following description is avoided for the purpose of easy understanding of those skilled in the art.

The accompanying drawings and the following description are provided in order that those skilled in the art sufficiently understand the present disclosure, but it is not intended that a subject matte of claims is limited to the accompanying drawings and the following description.

Each drawing is a schematic diagram, and is not necessarily precise depictions. In each drawing, the substantially same component is designated by the same reference mark, and the description is occasionally omitted or simplified.

First Exemplary Embodiment

A loudspeaker device according to a first exemplary embodiment and an acoustic system including the loudspeaker device will be described below with reference to FIGS. 1 to 15.

[1-1. Entire Configuration of Acoustic System]

Figure 1:
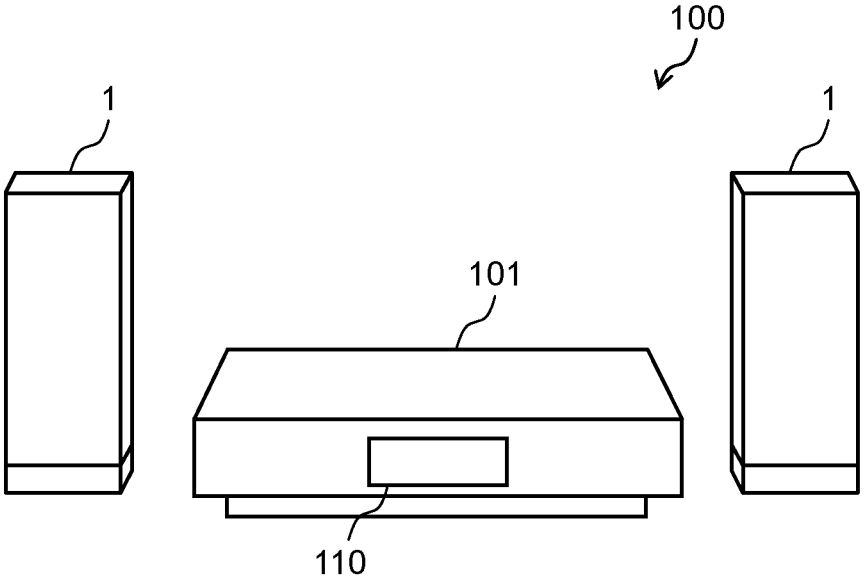
FIG. 1 schematically illustrates a configuration example of an acoustic system including a loudspeaker device according to a first exemplary embodiment.

FIG. 1 schematically illustrates a configuration example of acoustic system 100 including loudspeaker device 1 of the first exemplary embodiment. FIG. 1 is a perspective view of acoustic system 100 when acoustic system 100 is viewed from a front face side. In the first exemplary embodiment, it is assumed that a front face is a side on which operating part 110 of music player 101 is provided.

Acoustic system 100 includes one music player 101 and two loudspeaker devices 1. Quantities of music player 101 and loudspeaker device 1 are not limited to the above numerical values. Acoustic system 100 may include at least two music players 101. Acoustic system 100 may include one or at least three loudspeaker devices 1.

Loudspeaker device 1 is connected to music player 101, and can output (hereinafter, also simply referred to as "reproduce") an audio signal output from music player 101 while transducing the audio signal into sound.

Music player 101 is configured to be able to transduce a signal output from various external devices or music sources into the audio signal reproducible with loudspeaker device 1, and output the audio signal. For example, music player 101 may be configured to receive a signal associated with the sound from an external device wired through a connection terminal of USB (UNIVERSAL Serial Bus) or an external device wirelessly connected by Wi-Fi (registered trademark) or Bluetooth (registered trademark), and output the audio signal. Alternatively, music player 101 may be configured to receive the signal associated with the sound from a CD (Compact Disc) player included in music player 101 or a music source such as a radio, and output the audio signal.

[1-2. Configuration of Loudspeaker Device]

A configuration of loudspeaker device 1 of the first exemplary embodiment will be described below with reference to FIGS. 2 to 12.

Figure 2:
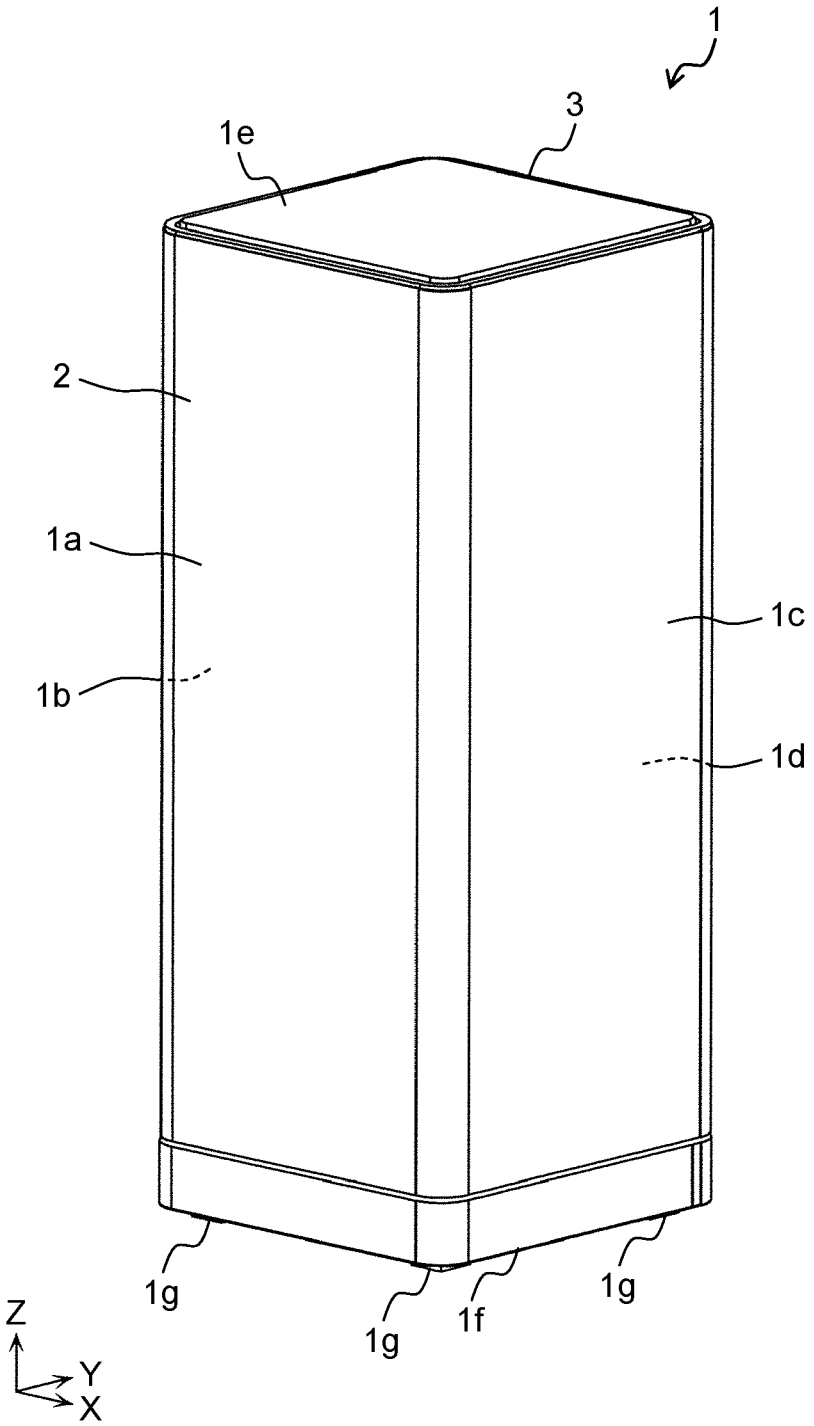
FIG. 2 is a perspective view schematically illustrating a configuration example of the loudspeaker device of the first exemplary embodiment.

FIG. 2 is a perspective view schematically illustrating a configuration example of loudspeaker device 1 of the first exemplary embodiment. FIG. 2 is a perspective view illustrating a front face of loudspeaker device 1 in FIG. 1 when loudspeaker device 1 is viewed in an oblique direction.

As illustrated in FIG. 2, loudspeaker device 1 has a rectangular parallelepiped shape that is longitudinal in a top-bottom direction (Z-axis direction). Loudspeaker device 1 is configured to be supported on a mounting surface (not illustrated) by a plurality of legs 1*g* provided in bottom face 1*f*. The first exemplary embodiment shows a configuration example where loudspeaker device 1 includes four legs 1*g*. However a number of legs 1*g* included in loudspeaker device 1 is not limited to four.

In loudspeaker device 1, top face 1*e* opposite to bottom face 1*f* is constructed with top board 3. Top board 3 also constitutes a design of loudspeaker device 1.

Loudspeaker device 1 includes top face 1*e*, bottom face 1*f*, and side face 1*a*, side face 1*b*, side face 1*c*, and side face 1*d* which are adjacent to top face 1*e* and bottom face 1*f*. In loudspeaker device 1, three side faces 1*a*, 1*b*, and 1*c* are constructed with exterior net 2. Exterior net 2 also constitutes the design of loudspeaker device 1. Side faces 1*a*, 1*b*, 1*c*, and 1*d* constituting the four side faces of the rectangular parallelepiped constitute a square cylinder.

In the first exemplary embodiment, for convenience, the description is made using three axes, namely, an X-axis, a Y-axis, and a Z-axis. It is assumed that a Z-axis positive direction is a direction from bottom face 1*f* toward top face 1*e*. It is assumed that a Y-axis positive direction is a direction from side face 1*a* that is the front face (hereinafter, also referred to as "front face 1*a*") toward side face 1*d* that is the rear face (hereinafter, also referred to as "rear face 1*d*"). It is assumed that an X-axis positive direction is a direction from side face 1*b* toward side face 1*c*.

Figure 3:
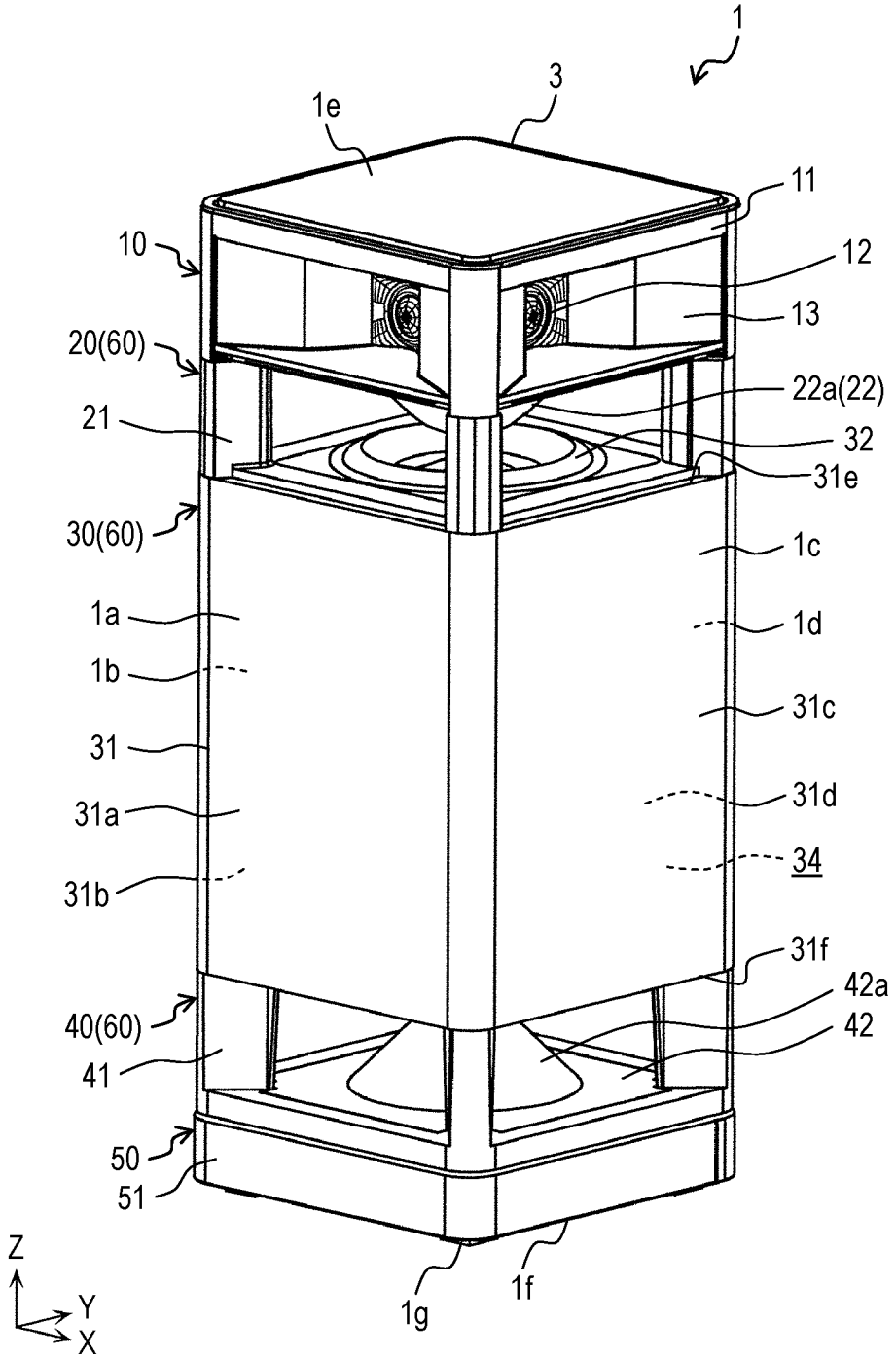
FIG. 3 is a perspective view schematically illustrating a configuration example of the loudspeaker device of the first exemplary embodiment.
Figure 4:
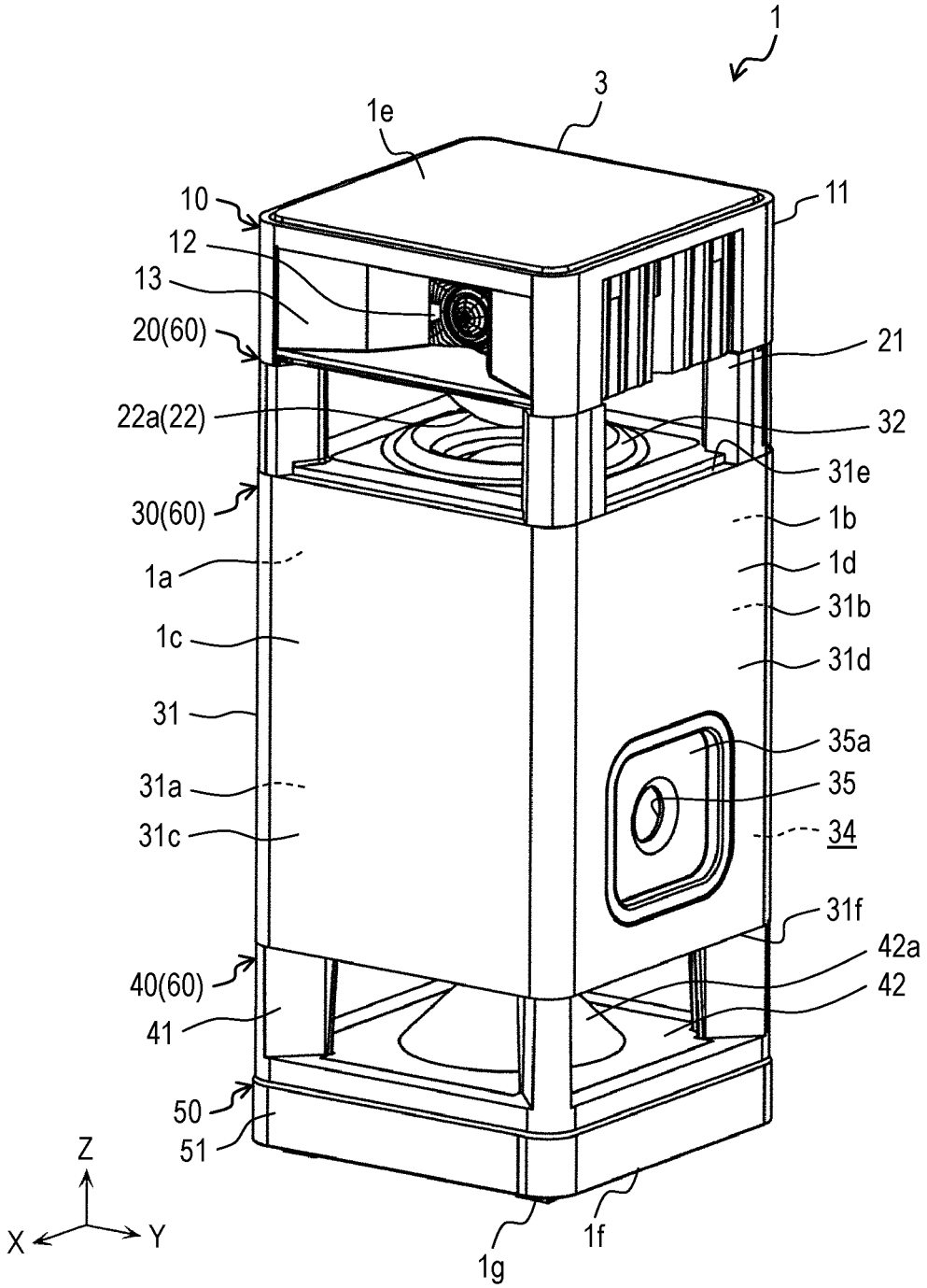
FIG. 4 is a perspective view schematically illustrating a configuration example of the loudspeaker device of the first exemplary embodiment.

FIGS. 3 and 4 are perspective views schematically illustrating a configuration example of loudspeaker device 1 according to the first exemplary embodiment. FIG. 3 is a perspective view illustrating a state in which exterior net 2 is removed from loudspeaker device 1 in FIG. 2, and FIG. 4 is a perspective view illustrating a rear face of loudspeaker device 1 in FIG. 3 when loudspeaker device 1 is viewed in an oblique direction.

Figure 5:
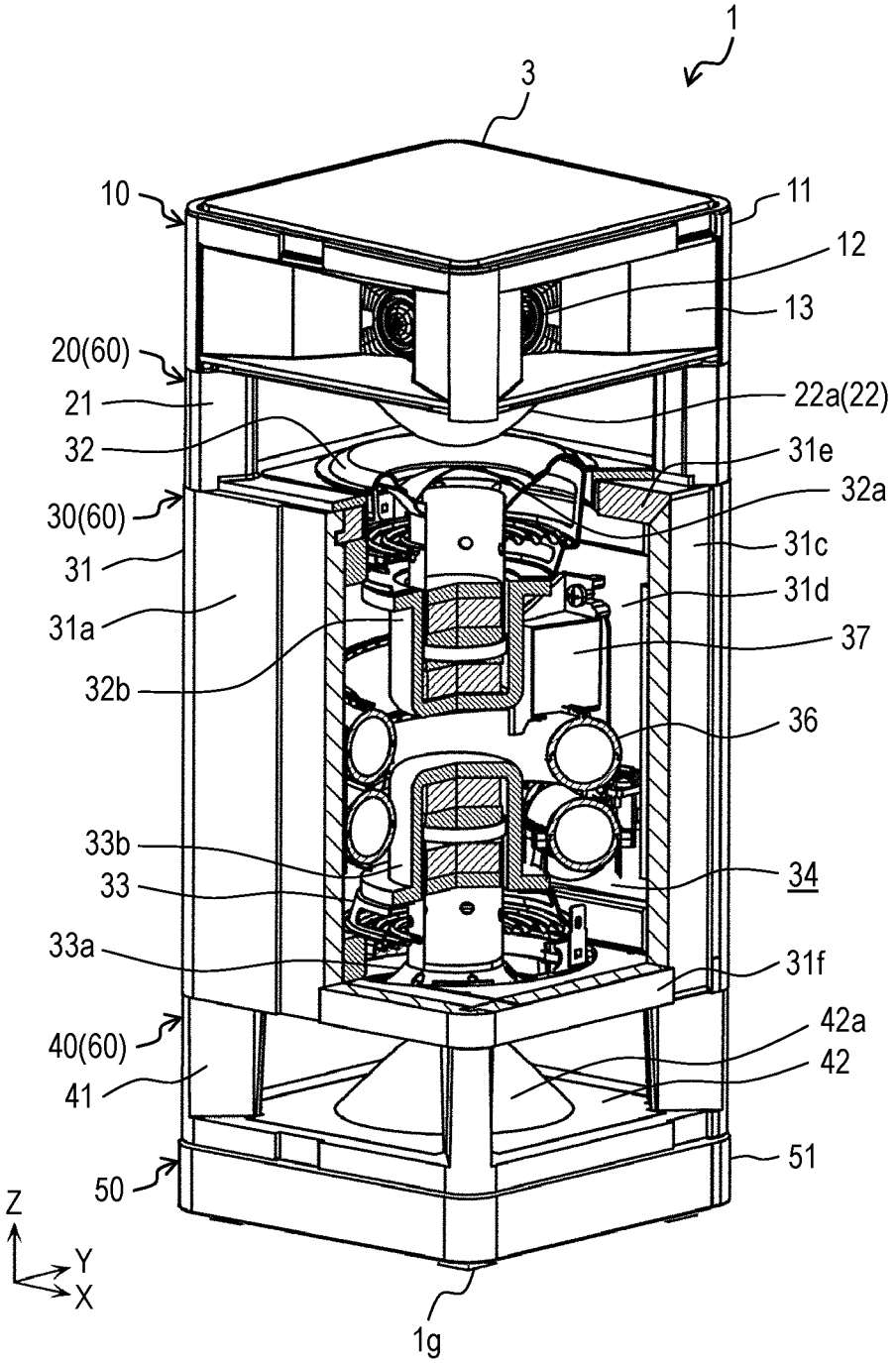
FIG. 5 is a perspective view schematically illustrating an example of an internal structure of the loudspeaker device of the first exemplary embodiment.
Figure 6:
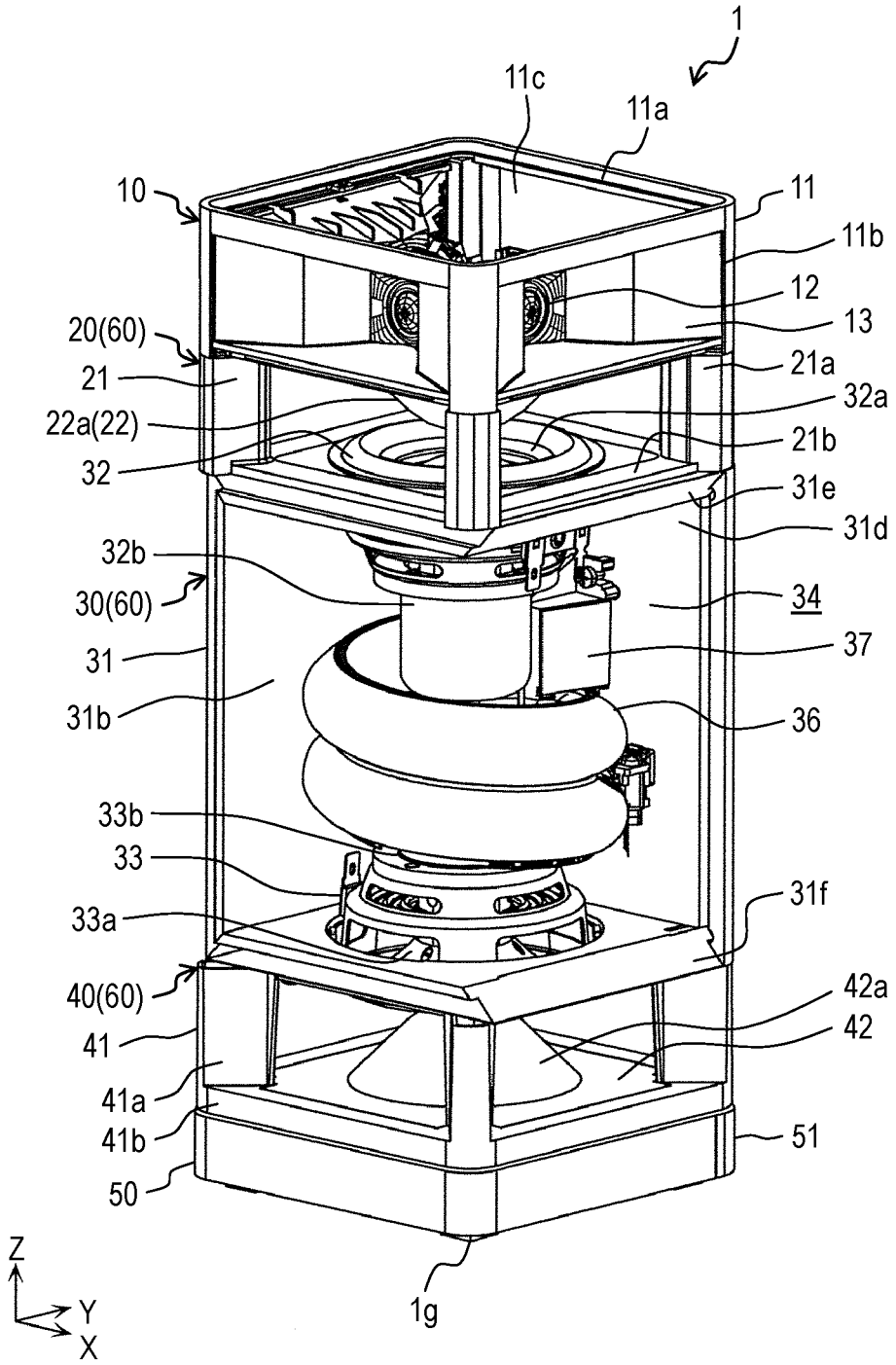
FIG. 6 is a perspective view schematically illustrating an example of the internal structure of the loudspeaker device of the first exemplary embodiment.
Figure 7:
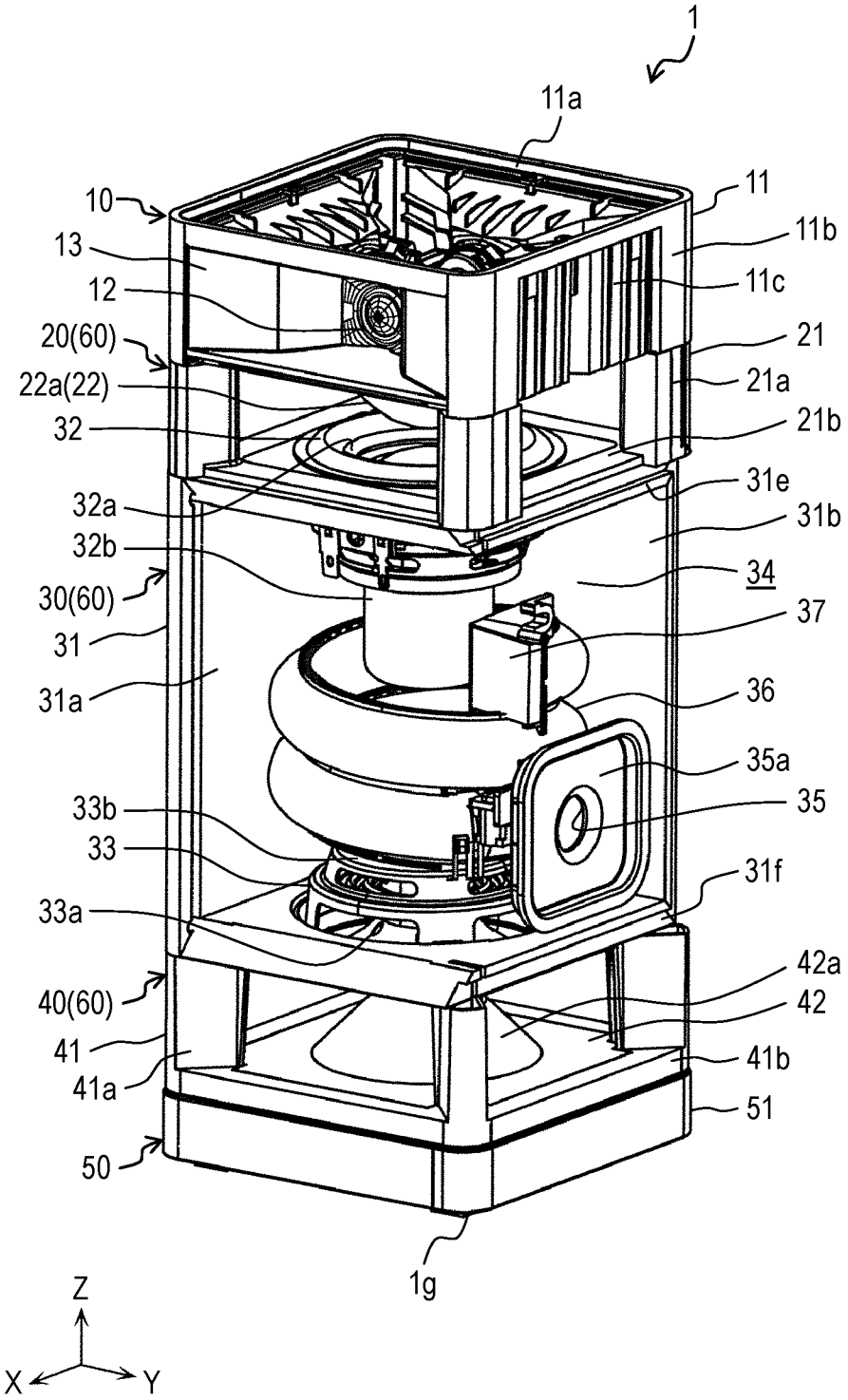
FIG. 7 is a perspective view schematically illustrating an example of the internal structure of the loudspeaker device of the first exemplary embodiment.

FIGS. 5, 6 and 7 are perspective views schematically illustrating an example of an internal structure of loudspeaker device 1 according to the first exemplary embodiment. FIG. 5 is a partial sectional view illustrating the internal structure of loudspeaker device 1 in FIG. 3 while loudspeaker device 1 is partially cut. FIG. 6 is a perspective view illustrating a state in which top board 3 and sidewalls 31*a* and 31*c* of loudspeaker housing 31 are removed from loudspeaker device 1 in FIG. 3. FIG. 7 is a perspective view illustrating a state in which top board 3 and sidewalls 31*c* and 31*d* of loudspeaker housing 31 are removed from loudspeaker device 1 in FIG. 4.

The following description will be made with reference to FIGS. 3 to 7. Loudspeaker device 1 includes tweeter 10, upper diffuser 20, woofer loudspeaker 30, lower diffuser 40, and pedestal 50. Tweeter 10 is disposed between top face 1*e* and upper diffuser 20, and includes a plurality of tweeter units 12. Upper diffuser 20, woofer loudspeaker 30, and lower diffuser 40 constitute woofer 60 in loudspeaker device 1. Woofer 60 is configured to take charge of reproduction of low-pitched to middle-pitched sounds in loudspeaker device 1. Tweeter 10 is configured to take charge of reproduction of middle-pitched to high-pitched sounds in loudspeaker device 1.

Tweeter frame 11 having a substantially rectangular parallelepiped contour is provided in tweeter 10. Substantially square frame-shaped upper edge 11*a*, four supports 11*b* separated from one another, and rectangular plate-shaped rear face wall 11*c* are integrally molded and included in tweeter frame 11. Each of four supports 11*b* is disposed so as to extend from each of four corners of upper edge 11*a* toward upper diffuser 20 in the Z-axis direction. Rear face wall 11*c* is disposed so as to extend between two supports 11*b* adjacent to each other on the side of rear face 1*d*. Rear face wall 11*c* closes a plane between two supports 11*b* on the side of rear face 1*d*. Upper edge 11*a* has a shape in which top board 3 is fitted while aligned with an inner periphery side of upper edge 11*a*.

In tweeter 10, three tweeter units 12, which are loudspeakers that can reproduce the high-pitched sound, are provided inside tweeter frame 11. Three tweeter units 12 are disposed so as to radially emit sound toward front face 1*a*, side face 1*b*, and side face 1*c* of loudspeaker device 1, respectively. That is, three tweeter units 12 are disposed such that orientations of tweeter units 12 are substantially orthogonal to one another on a plane (a horizontal direction, in the case that loudspeaker device 1 is mounted on the mounting surface parallel to a horizontal plane) substantially parallel to an XY-plane.

Tweeter unit 12 is configured to have a frequency characteristic of being able to reproduce sound having a frequency band of a predetermined high-pitched sound region. For example, the frequency band of the predetermined high-pitched sound region is a frequency range of 1 kHz to about 100 kHz or a frequency range of 2 kHz to 100 kHz or more.

In tweeter 10, directional control horn 13 is mounted on each tweeter unit 12. Directional control horn 13 is configured to have a trumpet shape, and to provide a directional characteristic to the sound reproduced with tweeter unit 12. Each of the plurality of directional control horns 13 extends from one tweeter unit 12, and a direction of each directional control horn 13 is set to a direction toward front face 1*a*, side face 1*b*, or side face 1*c*, which is an emission direction of the sound reproduced with the tweeter unit 12. Directional control horn 13 is opened between supports 11*b* of tweeter frame 11. Directional control horn 13 is disposed inside tweeter frame 11, and fixed to tweeter frame 11. In other words, one of three directional control horns 13 is disposed so as to radially emit the sound toward front face 1*a*, another one is disposed so as to radially emit the sound toward side face 1*b*, and the remaining one is disposed so as to radially emit the sound toward side face 1*c*.

Rectangular parallelepiped loudspeaker housing 31, in which the Z-axis direction is set to a longitudinal direction, is provided in woofer loudspeaker 30. Loudspeaker housing 31 has a hollow structure, and includes internal space 34. Woofer loudspeaker 30 includes upper woofer loudspeaker unit 32 and lower woofer loudspeaker unit 33. In loudspeaker housing 31, upper wall 31*e* and lower wall 31*f* are disposed in parallel to each other. Upper wall 31*e* is one oriented toward upper diffuser 20, and lower wall 31*f* is one oriented toward lower diffuser 40. Upper woofer loudspeaker unit 32 is embedded in an opening formed in upper wall 31*e* such that an output sound direction of upper woofer loudspeaker unit 32 is oriented toward upper diffuser 20. Lower woofer loudspeaker unit 33 is embedded in an opening formed in lower wall 31*f* such that an output sound direction of lower woofer loudspeaker unit 33 is oriented toward lower diffuser 40.

Upper woofer loudspeaker unit 32 and lower woofer loudspeaker unit 33 are configured to have a frequency characteristic of being able to suitably reproduce sound having a frequency band of a predetermined middle-pitched and low-pitched sound region. For example, the frequency band of the predetermined middle-pitched and low-pitched sound region is a frequency range of 35 Hz to 5000 Hz. Note that, one of upper wall 31*e* and lower wall 31*f* is an example of the first wall of the loudspeaker housing, and the other of upper wall 31*e* and lower wall 31*f* is an example of the second wall of the loudspeaker housing.

As described above, a mounting direction of upper woofer loudspeaker unit 32 is set such that upper woofer loudspeaker unit 32 emits the sound toward upper diffuser 20, and a mounting direction of lower woofer loudspeaker unit 33 is set such that lower woofer loudspeaker unit 33 emits the sound toward lower diffuser 40. When upper woofer loudspeaker unit 32 and lower woofer loudspeaker unit 33 are provided on woofer loudspeaker 30, a relatively large sound pressure can be obtained in woofer loudspeaker 30 even if each of upper woofer loudspeaker unit 32 and lower woofer loudspeaker unit 33 includes diaphragm 32*a* or diaphragm 33*a* (see FIG. 5) having a relatively small diameter of, for example, about 8 cm.

Furthermore, upper woofer loudspeaker unit 32 is provided in upper wall 31*e* of loudspeaker housing 31 and lower woofer loudspeaker unit 33 is provided in lower wall 31*f* of loudspeaker housing 31. Therefore, loudspeaker housing 31 can be miniaturized in the XY-plane, and a mounting area of loudspeaker device 1 can be reduced. Note that, one of upper woofer loudspeaker unit 32 and lower woofer loudspeaker unit 33 is an example of the first loudspeaker unit, and the other of upper woofer loudspeaker unit 32 and lower woofer loudspeaker unit 33 is an example of the second loudspeaker unit.

Upper frame 21 having a substantially rectangular parallelepiped contour is provided in upper diffuser 20. Upper frame 21 includes four supports 21*a* and substantially square plate-shaped support plate 21*b*. Four supports 21*a* are formed so as to be disposed while separated from one another, and extend in the Z-axis direction. Support plate 21*b* and four supports 21*a* are formed so as to be integrally molded. Four supports 21*a* are disposed in four corners of a square upper wall 31*e* of loudspeaker housing 31, respectively, and at four supports 11*b* of tweeter frame 11, respectively. Support plate 21*b* is formed so as to extend along upper wall 31*e*. Upper woofer loudspeaker unit 32 is disposed through the opening formed in support plate 21*b*, and diaphragm 32*a* of upper woofer loudspeaker unit 32 is exposed in upper frame 21. Support plate 21*b* is fixed to upper wall 31*e* of loudspeaker housing 31, supports 21*a* are fixed to tweeter frame 11, whereby upper frame 21 couples tweeter 10 and woofer loudspeaker 30 together.

In upper diffuser 20, diffuser body 22 is provided in upper frame 21. Diffuser body 22 includes conically projecting diffusion part 22*a*. Diffuser body 22 is disposed adjacent to tweeter frame 11, and fixed to support 21*a* of upper frame 21. Diffusion part 22*a* has an external form in which a tip of a cone is rounded, and has a hollow structure in which an opposite side to the tip is opened. The tip of diffusion part 22*a* projects toward upper woofer loudspeaker unit 32, and diffusion part 22*a* is disposed so as to face the center of diaphragm 32*a* of upper woofer loudspeaker unit 32. Accordingly, diffusion part 22*a* substantially uniformly diffuses the sound reproduced with upper woofer loudspeaker unit 32 in a direction along the XY-plane around loudspeaker device 1. For example, when loudspeaker device 1 is mounted on the mounting surface parallel to the horizontal plane, diffusion part 22*a* substantially nondirectionally diffuses the sound reproduced with upper woofer loudspeaker unit 32 over 360 degrees in the horizontal direction.

Figure 10:
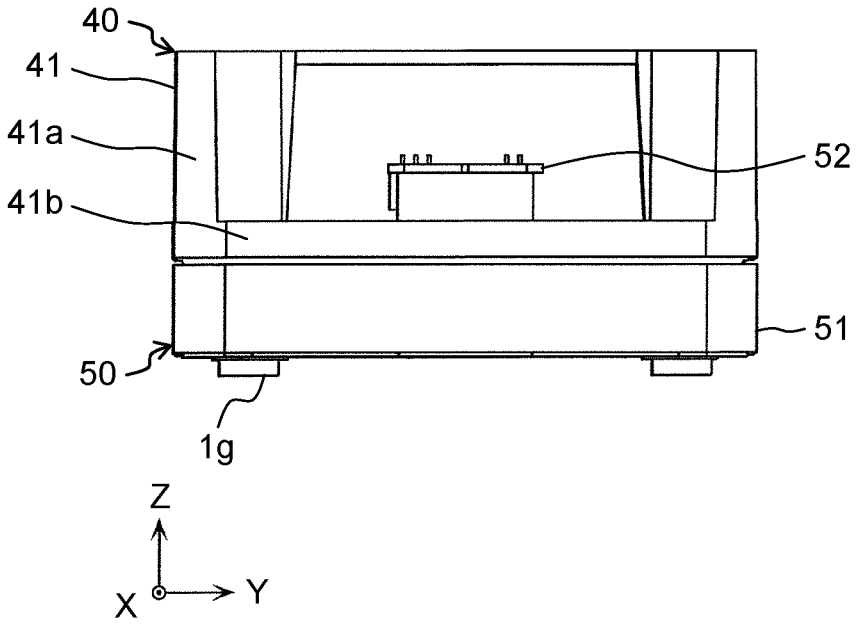
FIG. 10 is a side view schematically illustrating a configuration example of a pedestal included in the loudspeaker device of the first exemplary embodiment and a periphery of the pedestal.

FIG. 10 is a side view schematically illustrating a configuration example of pedestal 50 included in loudspeaker device 1 of the first exemplary embodiment and a periphery of pedestal 50. Although diffuser body 42 is mounted on the pedestal 50 as illustrated in FIG. 5, FIG. 10 illustrates pedestal 50 in which the diffuser body 42 is removed.

Box-shaped pedestal housing 51 is provided in pedestal 50. Pedestal housing 51 has a square shape in a planar shape, and is flat in the Z-axis direction. A plurality of legs 1*g* and a connection plug (not illustrated) are provided in a bottom portion of pedestal housing 51. The connection plug is a connection member that electrically connects music player 101 and loudspeaker device 1 in FIG. 1 to each other. As illustrated in FIG. 10, circuit board 52 is provided inside pedestal housing 51, and a circuit that controls operation of upper woofer loudspeaker unit 32 and lower woofer loudspeaker unit 33 is mounted on circuit board 52. Circuit board 52 is disposed so as to project in lower diffuser 40, and electrically connected to the connection plug. A weight (not illustrated) may be provided in pedestal housing 51 in order to improve stability of loudspeaker device 1 mounted on a mounting surface such as a floor.

The description will be made again with reference to FIGS. 3 to 7.

Lower frame 41 having a substantially rectangular parallelepiped contour is provided in lower diffuser 40. Lower frame 41 includes four supports 41*a* and four beams 41*b*. Four supports 41*a* are formed so as to be disposed while separated from one another, and extended in the Z-axis direction. Each of four beams 41*b* couples adjacent supports 41*a* together. Four supports 41*a* are disposed in four corners of a square lower wall 31*f* of loudspeaker housing 31, respectively, and in four corners at the sides of pedestal housing 51, respectively. Four beams 41*b* are disposed at ends of supports 41*a* on the side of pedestal housing 51, respectively, and extend along outer edges of the pedestal housing 51. When supports 41*a* are fixed to lower wall 31*f* of loudspeaker housing 31 and pedestal housing 51, lower frame 41 couples woofer loudspeaker 30 and pedestal 50 together.

In lower diffuser 40, diffuser body 42 is provided in lower frame 41. Diffuser body 42 includes conically projecting diffusion part 42*a*. Diffusion part 42*a* has an external form in which the tip of the cone is rounded, and has a hollow structure in which the opposite side to the tip is opened. Diffuser body 42 has a shape similar to diffuser body 22. Diffuser body 42 is disposed adjacent to pedestal housing 51, and fixed to beams 41*b* of lower frame 41. The tip of diffusion part 42*a* projects toward lower woofer loudspeaker unit 33, and diffusion part 42*a* is disposed so as to face the center of diaphragm 33*a* of lower woofer loudspeaker unit 33. Accordingly, diffusion part 42*a* substantially uniformly diffuses the sound reproduced with lower woofer loudspeaker unit 33 in the direction along the XY-plane around loudspeaker device 1. For example, when loudspeaker device 1 is mounted on the mounting surface parallel to the horizontal plane, diffusion part 42*a* substantially nondirectionally diffuses the sound reproduced with lower woofer loudspeaker unit 33 over 360 degrees in the horizontal direction.

The detailed configuration of woofer loudspeaker 30 will be described with reference to FIGS. 3 to 5.

In addition to upper wall 31*e* and lower wall 31*f*, loudspeaker housing 31 of woofer loudspeaker 30 includes sidewalls 31*a*, 31*b*, 31*c*, and 31*d* that are adjacent to upper wall 31*e* and lower wall 31*f*. Sidewall 31*a* is located in front face 1*a* of loudspeaker device 1, sidewall 31*b* is located in side face 1*b*, sidewall 31*c* is located in side face 1*c*, and sidewall 31*d* is located in rear face 1*d*.

Closed internal space 34 surrounded by upper woofer loudspeaker unit 32, lower woofer loudspeaker unit 33, sidewalls 31*a* to 31*d*, upper wall 31*e*, and lower wall 31*f* are formed inside loudspeaker housing 31. In upper woofer loudspeaker unit 32 and lower woofer loudspeaker unit 33, for example, as illustrated in FIG. 5, diaphragm 32*a* and diaphragm 33*a* are disposed so as to face internal space 34 and the outside of loudspeaker housing 31, respectively. Upper woofer loudspeaker unit 32 and lower woofer loudspeaker unit 33 are disposed in internal space 34 while separated from each other in the Z-axis direction. For example, internal space 34 may have a relatively small volume of about 800 cubic centimeters as a volume of the loudspeaker housing. Note that, each of sidewalls 31*a*, 31*b*, 31*c*, and 31*d* is an example of the sidewall of the loudspeaker housing.

As shown in the example of FIG. 4, acoustic port 35 is formed in sidewall 31*d* (hereinafter, also referred to as a "rear-face-side sidewall 31*d*") located in rear face 1*d*. Acoustic port 35 is a bass reflex port opened circularly. Port plate 35*a* fitted in rear-face-side sidewall 31*d* is circularly pierced to form acoustic port 35.

The following description will be made with reference to FIGS. 5 to 9.

Figure 8:
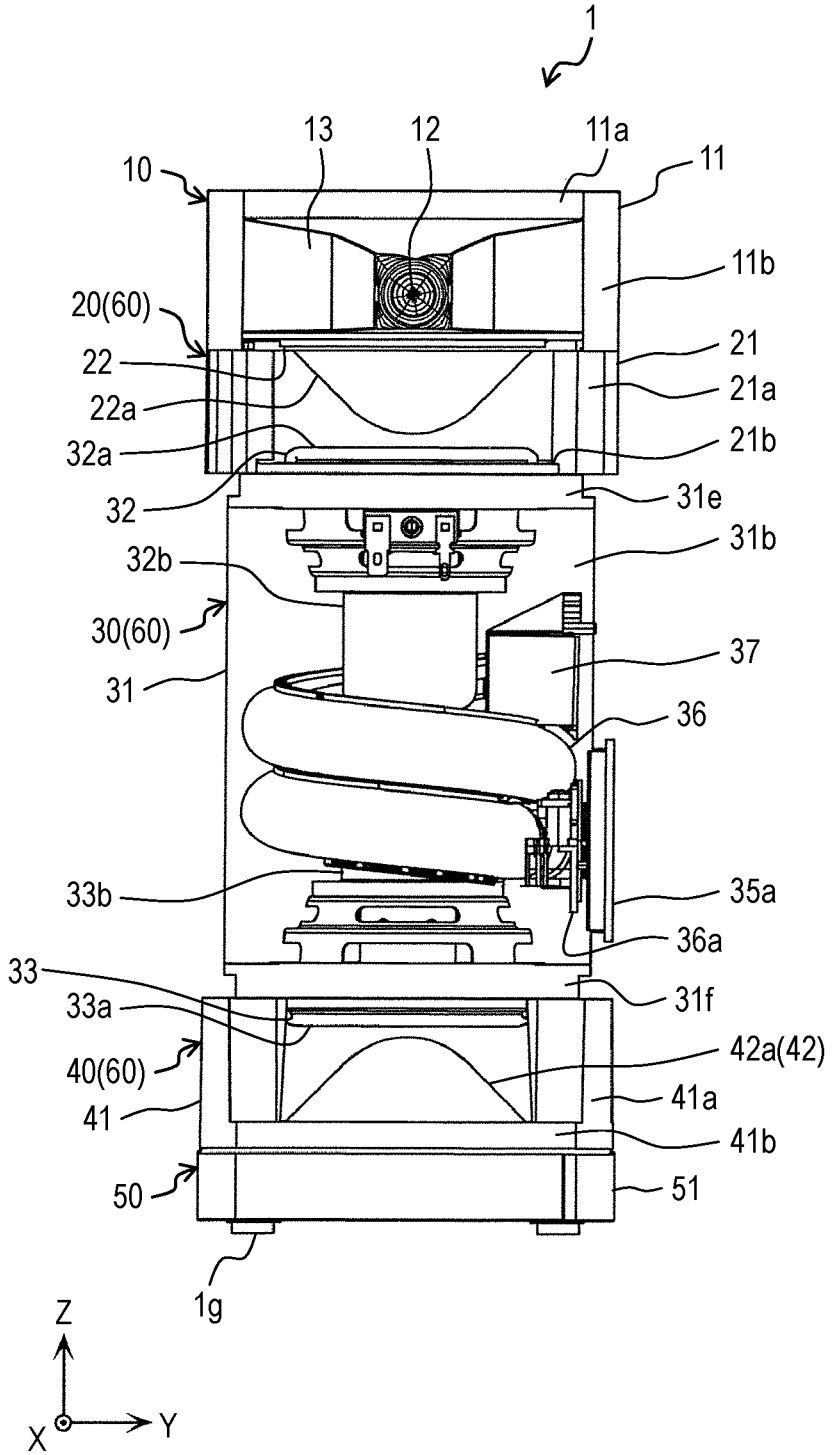
FIG. 8 is a side view schematically illustrating an example of the internal structure of the loudspeaker device of the first exemplary embodiment.

FIG. 8 is a side view schematically illustrating an example of the internal structure of loudspeaker device 1 of the first exemplary embodiment. FIG. 8 is a side view illustrating loudspeaker device 1 in FIG. 7, in which sidewall 31*a* of loudspeaker housing 31 is removed, when loudspeaker device 1 is viewed from the side of sidewall 31*c*.

Figure 9:
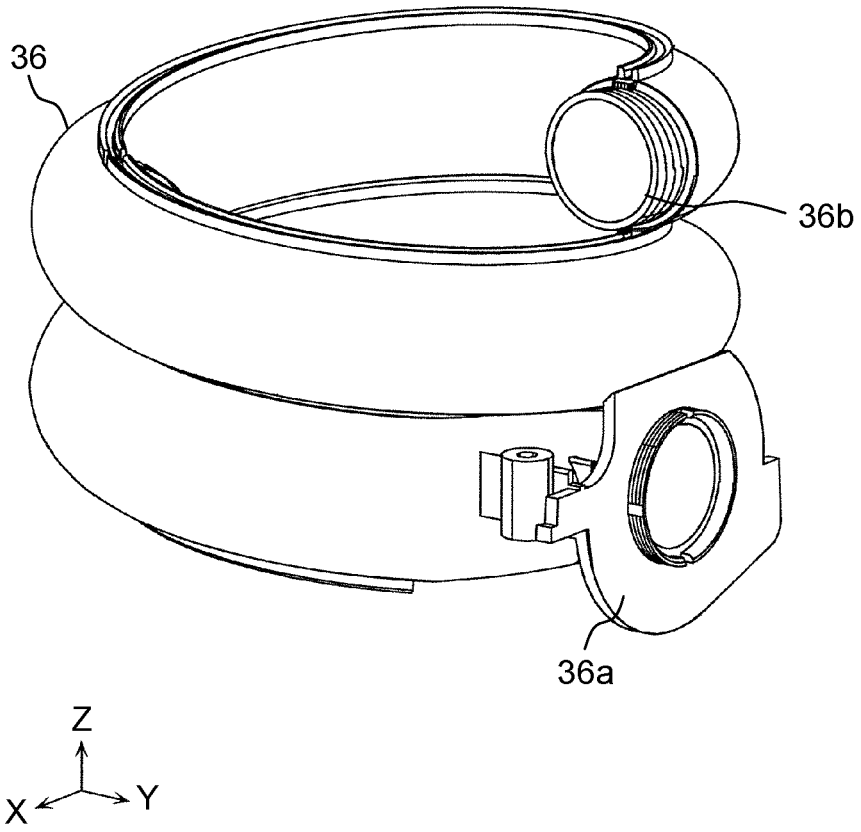
FIG. 9 is a perspective view schematically illustrating a configuration example of an acoustic tube in the loudspeaker device of the first exemplary embodiment.

FIG. 9 is a perspective view schematically illustrating a configuration example of acoustic tube 36 of loudspeaker device 1 of the first exemplary embodiment. FIG. 9 illustrates single acoustic tube 36 of loudspeaker device 1 shown in FIG. 7.

In internal space 34 of loudspeaker housing 31, acoustic tube 36 having a circular section is provided between upper woofer loudspeaker unit 32 and lower woofer loudspeaker unit 33. Acoustic tube 36 is formed so as to extend helically around upper woofer loudspeaker unit 32 and lower woofer loudspeaker unit 33. Specifically, acoustic tube 36 has a shape going around cylindrical vibrator generator (also referred to as a magnetic circuit) 32*b* that drives diaphragm 32*a* of upper woofer loudspeaker unit 32 and cylindrical vibrator generator (magnetic circuit) 33*b* that drives diaphragm 33*a* of lower woofer loudspeaker unit 33. Structures that vibrate diaphragms 32*a* and 33*a* according to the audio signal are disposed in vibrator generators (magnetic circuits) 32*b* and 33*b*.

For example, acoustic tube 36 may be formed into a helix shape having a smooth bending angle. Furthermore, acoustic tube 36 may be formed while uniformly bent. Furthermore, acoustic tube 36 may be formed so as to have an outer diameter as large as possible to an extent that comes into contact with sidewalls 31*a*, 31*b*, 31*c*, and 31*d* of loudspeaker housing 31. In the first exemplary embodiment, acoustic tube 36 is formed so as to have the large outer diameter coming close to sidewalls 31*a*, 31*b*, 31*c*, and 31*d*.

Flange 36*a* located at one end of acoustic tube 36 is coupled to port plate 35*a* (see FIGS. 4 and 9). Acoustic tube 36 has the substantially same inner diameter as the acoustic port 35, and is communicated to acoustic port 35. End 36*b* which is the other end of acoustic tube 36 is opened to internal space 34 of loudspeaker housing 31. Acoustic tube 36 and acoustic port 35 communicate the outside of loudspeaker housing 31 and internal space 34 to each other. The opening at end 36*b* of acoustic tube 36 is covered with sound absorbing material 37 (acoustic absorber) (see FIG. 6). Sound absorbing material 37 is configured to have a function of damping and absorbing the sound. For example, sound absorbing material 37 is made from a material such as polyester. Sound absorbing material 37 functions to damp a resonance caused by a length (that is, a port length) of acoustic tube 36. That is, sound absorbing material 37 has an effect that damps the resonance caused by the port length. Acoustic tube 36 is fixed to sidewall 31*d* on the rear face side of loudspeaker housing 31 via port plate 35*a* and a frame member of sound absorbing material 37. Sound absorbing material 37 is not necessarily provided.

Upper woofer loudspeaker unit 32, lower woofer loudspeaker unit 33, acoustic port 35, acoustic tube 36, and loudspeaker housing 31 constitute the bass reflex type loudspeaker. In loudspeaker device 1 that is the bass reflex type loudspeaker, a spring characteristic of air in internal space 34 and acoustic mass of acoustic tube 36 and acoustic port 35 can resonate by receiving the vibrations of diaphragm 32*a* of upper woofer loudspeaker unit 32 and diaphragm 33*a* of lower woofer loudspeaker unit 33. That is, loudspeaker device 1 can perform the bass reflex resonance.

In the case that the resonance is not generated, the sound radiated to the front faces of diaphragms 32*a* and 33*a* and the sound radiated to the rear faces of diaphragms 32*a* and 33*a* are opposite to each other in a phase. On the other hand, in loudspeaker device 1, a phase rotation of the sound radiated to the rear faces of diaphragms 32*a* and 33*a* is generated by the bass reflex resonance. Therefore, air resonating near a bass reflex resonance frequency in internal space 34 is composed with air emitted from diaphragms 32*a* and 33*a* toward a direction of diffuser body 22 and diffuser body 42. This enables the sound pressure to be enhanced in loudspeaker device 1. The resonating air can occasionally reduce excursions of diaphragms 32*a* and 33*a*. The bass reflex resonance frequency is a resonance frequency in the bass reflex resonance.

Bass reflex resonance frequency Fb is given by the following equation.

$$Fb=((1/M\cdot C)\hat{}(1/2))/2\pi$$

(A symbol of ^ expresses exponential)

Note that, M is an element associated with the acoustic mass of acoustic tube 36, and C is an element associated with the volume of internal space 34. The bass reflex resonance can effectively increase the sound pressures of diaphragms 32*a* and 33*a*, and effectively decrease the excursions of diaphragm 32*a* and 33*a*.

In the first exemplary embodiment, in order to increase the sound pressures in deep low-pitched sound regions of upper woofer loudspeaker unit 32 and lower woofer loudspeaker unit 33, the bass reflex resonance frequency is set to a predetermined frequency in the deep low-pitched sound region, which is lower than or equal to a frequency band in which upper woofer loudspeaker unit 32 and lower woofer loudspeaker unit 33 can suitably reproduce the sound. In this case, it is necessary to increase elements M and C to correspond to the low bass reflex resonance frequency. For example, the predetermined frequency in the deep low-pitched sound region can be set to, but not limited to, a range of 30 Hz to 50 Hz and a frequency band of the sound near the range.

In the first exemplary embodiment, elements M and C corresponding to the bass reflex resonance frequency are decided while element C is relatively decreased. Specifically, for example, a volume of internal space 34 associated with element C is previously set to the relatively small volume of about 800 cubic centimeters, and element M is relatively increased. That is, in the first exemplary embodiment, acoustic tube 36 is configured such that the acoustic mass of acoustic tube 36 is relatively increased. In order to increase the acoustic mass, acoustic tube 36 is configured such that the inner diameter is relatively small while the tube length is relatively long.

A noise is easily generated when an air speed in tube, which is an air speed in acoustic tube 36, increases. Therefore, the acoustic tube 36 may be configured such that a frequency at which the air speed in tube is maximized by the bass reflex resonance becomes a predetermined frequency (for example, a frequency of an ultra low-pitched sound region hardly included in the sound and music signal). At this point, acoustic tube 36 is configured such that the tube length is relatively long. For example, the ultra low-pitched sound region can be set to a range of 10 Hz to 30 Hz and a frequency band of the sound near the range.

In the description above, the inner diameter of acoustic tube 36 is set to be relatively small in order to increase the acoustic mass. However, the inner diameter of acoustic tube 36 is also set in consideration of suppressing a resistance against the air passing through the long acoustic tube 36.

The inner diameter and tube length of acoustic tube 36 are decided based on the above conditions. For example, in the first exemplary embodiment, in the case that the volume of internal space 34 is set to 800 cubic centimeters while the bass reflex resonance frequency is set to 40 Hz, the inner diameter of acoustic tube 36 can be set to 16 mm while tube length can be set to 450 mm. Acoustic tube 36 is bent in order that the relatively long acoustic tube 36 is accommodated in the relatively small internal space 34.

The configurations of acoustic tube 36 and internal space 34 can suppress the excursions of diaphragm 32*a* of upper woofer loudspeaker unit 32 and diaphragm 33*a* of lower woofer loudspeaker unit 33 at the bass reflex resonance frequency and in the frequency band near the bass reflex resonance frequency. In the case that the excursions of diaphragms 32*a* and 33*a* are relatively decreased at the bass reflex resonance frequency and in the frequency band near the bass reflex resonance frequency, boost control is performed on upper woofer loudspeaker unit 32 and lower woofer loudspeaker unit 33 such that the sound pressure is electrically increased in the frequency band, which allows distortion to be suppressed in the reproduced sound. On the other hand, when the above boost control is performed on upper woofer loudspeaker unit 32 and lower woofer loudspeaker unit 33 while the excursions of diaphragms 32*a* and 33*a* are relatively large at the bass reflex resonance frequency and in the frequency band near the bass reflex resonance frequency, the sound includes the distortion.

Acoustic tube 36 and acoustic port 35 may be formed into a smooth shape, such as a circular shape, in order to decrease a viscous resistance of the inner surfaces of acoustic tube 36 and acoustic port 35.

In the case that acoustic tube 36 is relatively abruptly bent, a frictional noise (that is, air-cut noise) of the air flowing through acoustic tube 36 is relatively increased. In order to suppress the air-cut noise, the acoustic tube 36 may relatively smoothly bent, and the bending angle and bending radius of the acoustic tube 36 may be relatively large. Acoustic tube 36 may uniformly be bent. For example, as shown in the first exemplary embodiment, acoustic tube 36 has the outer diameter enough to be inscribed in sidewalls 31*a*, 31*b*, 31*c*, and 31*d* of loudspeaker housing 31, and is formed into a helically extending shape, which allows loudspeaker device 1 to satisfy the above conditions. When acoustic tube 36 is formed into the helix shape, a region occupied by acoustic tube 36 in internal space 34 can be reduced.

Because acoustic tube 36 is disposed so as to be interposed between diaphragm 32*a* of upper woofer loudspeaker unit 32 and diaphragm 33*a* of lower woofer loudspeaker unit 33, acoustic tube 36 can diffuse vibration waves of diaphragms 32*a* and 33*a*, and suppress interference between the vibration waves. Therefore, generation of a standing wave caused by the interference between the vibration waves of diaphragms 32*a* and 33*a* can be reduced. Preferably, the standing wave is suppressed because the standing wave has an influence on the resonance of the air in internal space 34.

The circuit mounted on circuit board 52 shown in FIG. 10 can not only control the operation of upper woofer loudspeaker unit 32 and lower woofer loudspeaker unit 33, but also perform control for electrically boosting operation of upper woofer loudspeaker unit 32 and lower woofer loudspeaker unit 33. Specifically, in a frequency band in which the excursions of diaphragm 32*a* of upper woofer loudspeaker unit 32 and diaphragm 33*a* of lower woofer loudspeaker unit 33 are decreased by the bass reflex resonance, the circuit mounted on circuit board 52 increases signal voltages applied to upper woofer loudspeaker unit 32 and lower woofer loudspeaker unit 33, thereby performing boost control in order to increase the sound pressures of diaphragms 32*a* and 33*a*. Circuit board 52 (or the circuit mounted on circuit board 52) is an example of a boost controller.

Woofer 60 including upper diffuser 20, woofer loudspeaker 30, and lower diffuser 40, which have the above configurations, can reproduce the low-pitched sound with low distortion similarly to a loudspeaker including a large-diameter diaphragm, even if upper woofer loudspeaker unit 32 includes relatively small-diameter diaphragm 32*a*, and even if lower woofer loudspeaker unit 33 includes relatively small-diameter diaphragm 33*a*.

The detailed configuration of tweeter 10 will be described with reference to FIGS. 11 and 12.

Figure 11:
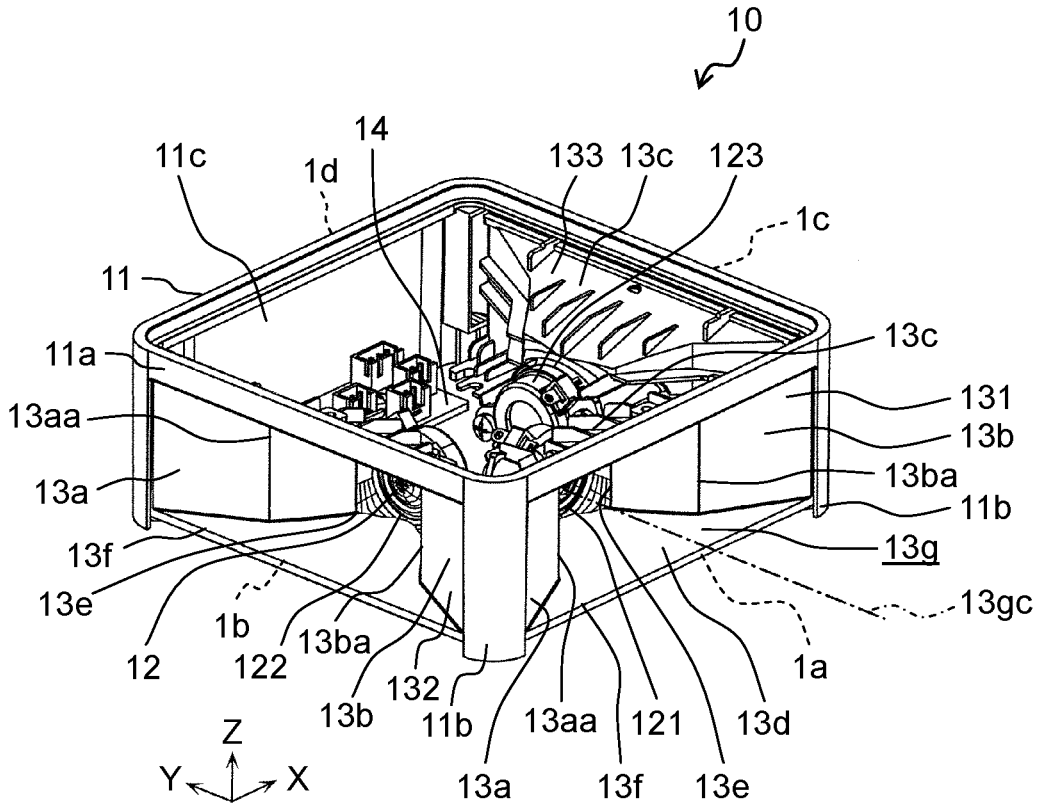
FIG. 11 is a perspective view schematically illustrating a configuration example of a tweeter included in the loudspeaker device of the first exemplary embodiment.

FIG. 11 is a perspective view schematically illustrating a configuration example of tweeter 10 included in loudspeaker device 1 of the first exemplary embodiment. FIG. 11 is a perspective view illustrating tweeter 10 of loudspeaker device 1 in FIG. 6 when tweeter 10 is viewed in a direction different from the direction in which tweeter 10 is viewed in FIG. 6.

Figure 12:
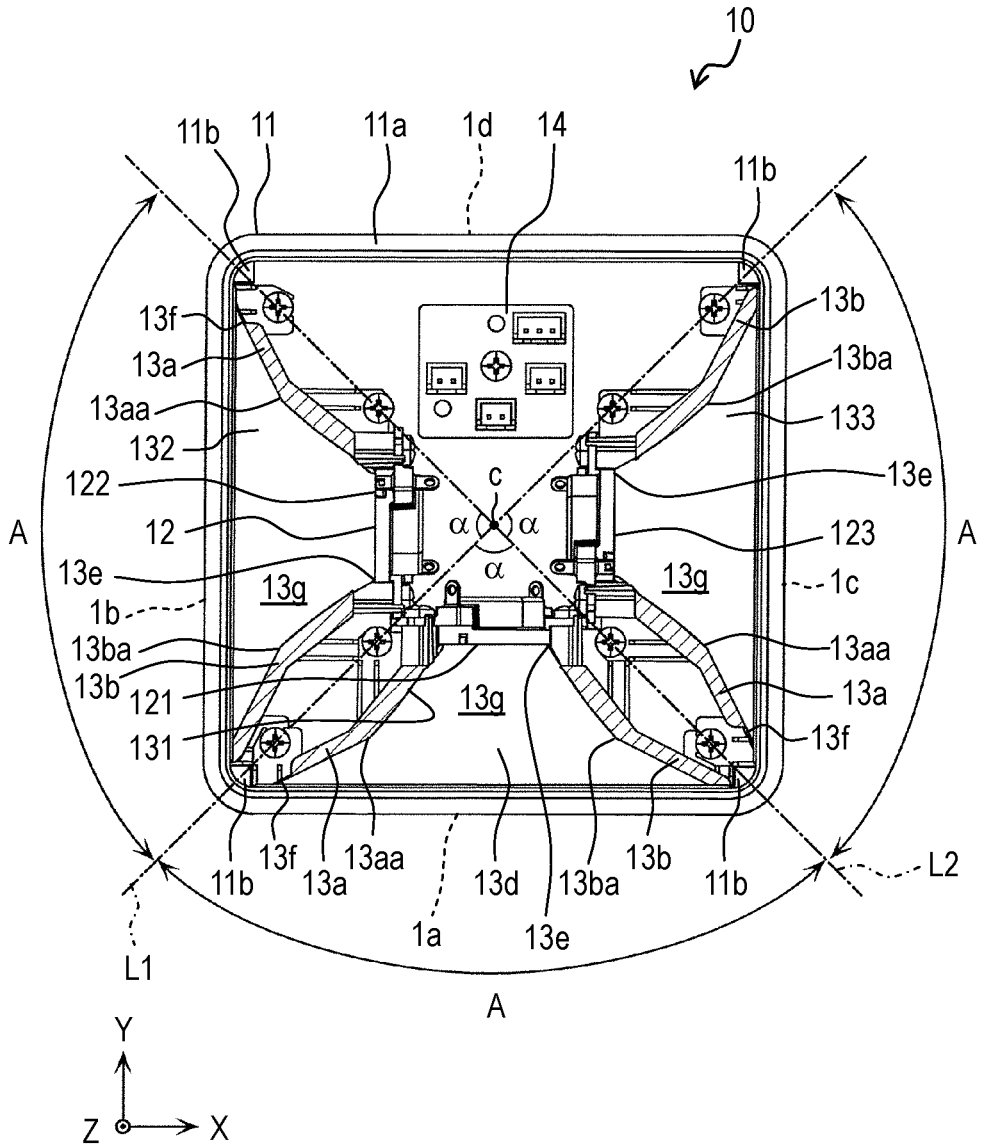
FIG. 12 is a top view schematically illustrating a configuration example of the tweeter included in the loudspeaker device of the first exemplary embodiment.

FIG. 12 is a top view schematically illustrating a configuration example of tweeter 10 included in loudspeaker device 1 of the first exemplary embodiment. FIG. 12 is a top view of tweeter 10 in FIG. 11 when tweeter 10 is viewed from above, illustrating tweeter 10 in which upper wall 13*c* of directional control horn 13 is removed.

Tweeter circuit board 14 on which a circuit controlling tweeter unit 12 is mounted is provided in tweeter frame 11 in addition to three tweeter units 12 and three directional control horns 13. Tweeter circuit board 14 is mounted on upper frame 21 of upper diffuser 20 shown in FIG. 6. The circuit mounted on tweeter circuit board 14 is electrically connected to three tweeter units 12, and configured to control operation of tweeter units 12. Hereinafter, for convenience, each of three tweeter units 12 are also referred to as first tweeter unit 121, second tweeter unit 122, and third tweeter unit 123. Three directional control horns 13 respectively mounted on first tweeter unit 121, second tweeter unit 122, and third tweeter unit 123 are also referred to as first directional control horn 131, second directional control horn 132, and third directional control horn 133, respectively.

First tweeter unit 121 and first directional control horn 131 are oriented toward front face 1*a* of loudspeaker device 1, second tweeter unit 122 and second directional control horn 132 are oriented toward side face 1*b* of loudspeaker device 1, and third tweeter unit 123 and third directional control horn 133 are oriented toward side face 1*c* of loudspeaker device 1. Accordingly, first tweeter unit 121 and first directional control horn 131, second tweeter unit 122 and second directional control horn 132, and third tweeter unit 123 and third directional control horn 133 are disposed such that orientations of first tweeter unit 121 and first directional control horn 131, orientations of second tweeter unit 122 and second directional control horn 132, and orientations of third tweeter unit 123 and third directional control horn 133 are substantially orthogonal to one another in a plane (the horizontal direction, in the case that loudspeaker device 1 is mounted on the mounting surface parallel to the horizontal plane) substantially parallel to the XY-plane. Second tweeter unit 122 and second directional control horn 132, and third tweeter unit 123 and third directional control horn 133 are disposed such that the orientations of second tweeter unit 122 and second directional control horn 132 and the orientations of third tweeter unit 123 and third directional control horn 133 are substantially opposite to each other.

Each of first directional control horn 131, second directional control horn 132, and third directional control horn 133 includes fan-shaped bottom wall 13*d* disposed on the side of upper diffuser 20 (see FIG. 6), fan-shaped upper wall 13*c* disposed at a position facing bottom wall 13*d*, and sidewalls 13*a* and 13*b* disposed between upper wall 13*c* and bottom wall 13*d*. Upper wall 13*c* and bottom wall 13*d* are substantially symmetrical like a mirror image. Sidewalls 13*a* and 13*b* are substantially symmetrical like a mirror image.

First directional control horn 131, second directional control horn 132, and third directional control horn 133 are formed into a trumpet shape having a rectangular section by sidewall 13*a*, sidewall 13*b*, upper wall 13*c*, and bottom wall 13*d*.

Sidewall 13*a*, sidewall 13*b*, upper wall 13*c*, and bottom wall 13*d* of first directional control horn 131 constitute opening 13*e* in which first tweeter unit 121 is mounted and opening 13*f* on the side of front face 1*a* that is the emission direction of the sound reproduced with first tweeter unit 121.

Sidewall 13*a*, sidewall 13*b*, upper wall 13*c*, and bottom wall 13*d* of second directional control horn 132 constitute opening 13*e* in which second tweeter unit 122 is mounted and opening 13*f* on the side of side face 1*b* that is the emission direction of the sound reproduced with second tweeter unit 122.

Sidewall 13*a*, sidewall 13*b*, upper wall 13*c*, and bottom wall 13*d* of third directional control horn 133 constitute opening 13*e* in which third tweeter unit 123 is mounted and opening 13*f* on the side of side face 1*c* that is the emission direction of the sound reproduced with third tweeter unit 123.

On the insides of first directional control horn 131, second directional control horn 132, and third directional control horn 133, diffusion path 13*g* spreading from opening 13*e* toward opening 13*f* in the trumpet shape is formed by sidewall 13*a*, sidewall 13*b*, upper wall 13*c*, and bottom wall 13*d*.

Each of first directional control horn 131, second directional control horn 132, and third directional control horn 133 is oriented such that central axis 13*gc* of each of diffusion paths 13*g* is set along the XY-plane. In FIG. 11, only central axis 13*gc* of diffusion path 13*g* of first directional control horn 131 is indicated by an alternate long and short dash line, and other central axes 13*gc* are omitted to be illustrated. Central axis 13*gc* is an axis that is equidistant from each of sidewalls 13*a* and 13*b*, and is also equidistant from each of upper wall 13*c* and bottom wall 13*d*. Accordingly, when loudspeaker device 1 is mounted on the mounting surface parallel to the horizontal plane, each of central axes 13*gc* of first directional control horn 131, second directional control horn 132, and third directional control horn 133 is substantially parallel to the horizontal plane. That is, when loudspeaker device 1 is used in a usual operating state, central axes 13*gc* of first directional control horn 131, second directional control horn 132, and third directional control horn 133 are substantially parallel to the horizontal direction.

Upper wall 13*c* of each of first directional control horn 131, second directional control horn 132, and third directional control horn 133 is inclined onto the opposite side (on the side of top board 3) to upper diffuser 20 such that diffusion path 13*g* spreads in the Z-axis direction from opening 13*e* toward opening 13*f*. A width of each upper wall 13*c* is increased such that diffusion path 13*g* expands along the XY-plane from opening 13*e* toward opening 13*f*. In opening 13*f*, the width of each upper wall 13*c* expands to two adjacent supports 11*b*.

Bottom wall 13*d* of each of first directional control horn 131, second directional control horn 132, and third directional control horn 133 is inclined onto the side of upper diffuser 20 such that diffusion path 13*g* spreads in the Z-axis direction from opening 13*e* toward opening 13*f*. The width of each bottom wall 13*d* is increased such that diffusion path 13*g* expands along the XY-plane from opening 13*e* toward opening 13*f*. In opening 13*f*, the width of each bottom wall 13*d* expands to two adjacent supports 11*b*.

Bottom wall 13*d* may be formed, from opening 13*e* toward opening 13*f*, so as not to be inclined onto the side of upper diffuser 20, but to be substantially parallel to the XY-plane. Alternatively, bottom wall 13*d* may be formed so as to be inclined onto the opposite side to upper diffuser 20. In the first exemplary embodiment, upper wall 13*c* is inclined onto the opposite side to upper diffuser 20 from opening 13*e* toward opening 13*f*. Accordingly, when loudspeaker device 1 is mounted on the mounting surface substantially parallel to the horizontal plane, namely, when loudspeaker device 1 is used in the usual operating state, directional control horn 13 directs the sound reproduced with tweeter unit 12 in a Z-axis upward direction from bottom wall 13*d* toward upper wall 13*c*.

Sidewalls 13*a* and 13*b* of each of first directional control horn 131, second directional control horn 132, and third directional control horn 133, diffusion path 13*g* is formed along edges of upper wall 13*c* and bottom wall 13*d* such that diffusion path 13*g* expands along the XY-plane from opening 13*e* toward opening 13*f*. Sidewall 13*a* includes bent portion 13*aa* in the middle from opening 13*e* toward opening 13*f*, and sidewall 13*b* includes bent portion 13*ba* in the middle from opening 13*e* toward opening 13*f*. Sidewalls 13*a* and 13*b* are bent in bent portions 13*aa* and 13*ba* respectively so as to be farther separated from each other from opening 13*e* toward opening 13*f*. Accordingly, as to a rate of increase in width of diffusion path 13*g* from opening 13*e* toward opening 13*f*, the rate of increase in width from bent portions 13*aa* and 13*ba* to opening 13*f* is larger than the rate of increase in width from opening 13*e* to bent portions 13*aa* and 13*ba*.

Each of first directional control horn 131, second directional control horn 132, and third directional control horn 133, which have the above configurations, can diffuse the sounds reproduced with each of first tweeter unit 121, second tweeter unit 122, and third tweeter unit 123 in the direction (the direction along the XY-plane) along the sidewalls 13*a* and 13*b* and the direction (Z-axis direction) along upper wall 13*c* and bottom wall 13*d*. Each of first directional control horn 131, second directional control horn 132, and third directional control horn 133 includes bent sidewalls 13*a* and 13*b*, so that a directional range of the sound can be controlled in the direction along the XY-plane (for example, the horizontal direction). That is, each of first directional control horn 131, second directional control horn 132, and third directional control horn 133 can control the directional characteristics of the sounds reproduced with each of first tweeter unit 121, second tweeter unit 122, and third tweeter unit 123 such that the sound is diffused while a most part of the sound is restricted to the directional range of a predetermined directional angle (for example, 90 degrees with respect to the horizontal direction).

This operation will specifically be described with reference to FIG. 12. As illustrated in FIG. 12, first directional control horn 131 is configured to diffuse the sound reproduced with first tweeter unit 121 while restricting the most part of the sound to directional range A of directional angle α in the direction along the XY-plane, second directional control horn 132 is configured to diffuse the sound reproduced with second tweeter unit 122 while restricting the most part of the sound to directional range A of directional angle α in the direction along the XY-plane, third directional control horn 133 is configured to diffuse the sound reproduced with third tweeter unit 123 while restricting the most part of the sound to directional range A of directional angle α in the direction along the XY-plane. In the first exemplary embodiment, directional range A may be set to a region between line segment L1 and line segment L2 with respect to each of first directional control horn 131, second directional control horn 132, and third directional control horn 133. Line segments L1 and L2 are those that pass from diffusion reference point C to both ends of opening 13*f*, specifically, the center of support 11*b*. Diffusion reference point C is a virtual point that is set to the rear of first tweeter unit 121, second tweeter unit 122, and third tweeter unit 123. In FIG. 12, line segment L1 and line segment L2 are indicated by an alternate long and dash line. Directional angle α is one formed between line segment L1 and line segment L2.

In the first exemplary embodiment, directional angle α is set to 90 degrees. In designing directional control horn 13 (first directional control horn 131, second directional control horn 132, and third directional control horn 133) having directional angle α, it is not always necessary to design to direct the sound at all frequencies into directional range A of directional angle α. Each of first directional control horn 131, second directional control horn 132, and third directional control horn 133 may be designed to direct the sound having the frequency reproducible with tweeter unit 12 (first tweeter unit 121, second tweeter unit 122, or third tweeter unit 123), the sound having the frequency suitably reproducible with tweeter unit 12, or the sound having the frequency usually reproduced with tweeter unit 12 into directional range A.

First directional control horn 131, second directional control horn 132, and third directional control horn 133 are disposed such that directional range A of each of first directional control horn 131, second directional control horn 132, and third directional control horn 133 does not substantially overlap each other in the direction along the XY-plane, but is adjacent to each other. This suppresses interference among the sounds reproduced with first tweeter unit 121, second tweeter unit 122, and third tweeter unit 123, which are emitted through first directional control horn 131, second directional control horn 132, and third directional control horn 133. Resultantly, loudspeaker device 1 can emit the sounds reproduced with first tweeter unit 121, second tweeter unit 122, and third tweeter unit 123 with a continuous, substantially uniform sound pressure in the directions of front face 1*a*, side face 1*b*, and side face 1*c* of loudspeaker device 1 except for rear face 1*d*, namely, in the directional range extending over 270 degrees in XY-plane. That is, loudspeaker device 1 used in the normal operating state can reproduce the substantially nondirectional sound over 270 degrees in the horizontal direction.

The term "directional range A of each of first directional control horn 131, second directional control horn 132, and third directional control horn 133 does not substantially overlap each other, but is adjacent to each other" includes the following three cases.

The first case is a case in which a gap exists slightly between directional ranges A which are adjacent to each other. However, the gap has a size such that the change of the sound pressure, sound quality and the like do not appear substantially as a measurement result between directional range A and a region of the gap.

The second case is a case in which adjacent directional ranges A are directly adjacent to each other without a gap and an overlap.

The third case is a case in which adjacent directional ranges A slightly overlap each other. However, the overlap has a size such that the changes in the sound pressure, sound quality, and the like caused by the interference in the overlapping region do not appear substantially as a measurement result when compared to directional range A.

[1-3. Practical Example of Loudspeaker Device]

Practical example 1 of loudspeaker device 1 of the first exemplary embodiment and comparative example 1 of a loudspeaker device that is not of the bass reflex type but a sealed type were compared to each other with respect to a characteristic of the woofer.

In woofer 60 of practical example 1, loudspeaker housing 31 had the inner volume of 800 cubic centimeters, acoustic port 35 and acoustic tube 36 had the diameter of 16 mm, and acoustic tube 36 had the length of 450 mm. Upper woofer loudspeaker unit 32 and lower woofer loudspeaker unit 33 had the diameter of 8 cm and the frequency band ranging from 100 Hz to 5000 Hz. The bass reflex resonance frequency was set to 40 Hz. As to the internal size of loudspeaker housing 31, the width in the X-axis direction was set to about 9 cm, the depth in the Y-axis direction was set to about 9 cm, and the height in the Z-axis direction was set to about 10 cm.

Compared with practical example 1, the loudspeaker device of comparative example 1 does not include acoustic port 35 and acoustic tube 36, but the loudspeaker housing had the sealed structure. The loudspeaker housing had the inner volume of 800 cubic centimeters. Other configurations of comparative example 1 are similar to those of practical example 1.

Figure 13:
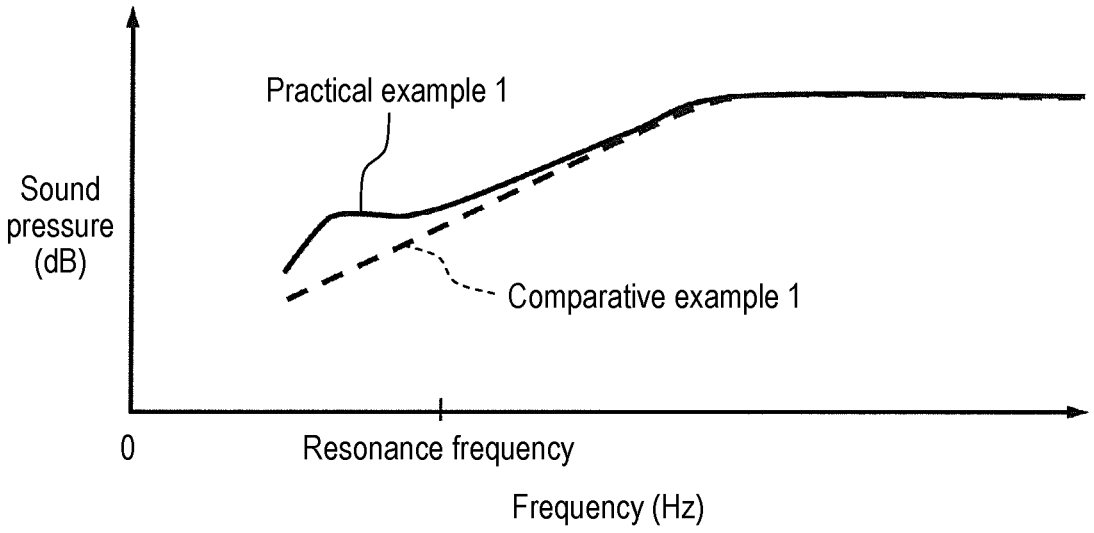
FIG. 13 schematically illustrates an example of a relationship between a sound pressure and a frequency of a woofer included in the loudspeaker device of the first exemplary embodiment.

FIG. 13 schematically illustrates an example of a relationship between a sound pressure and a frequency of woofer 60 included in loudspeaker device 1 of the first exemplary embodiment. FIG. 13 is a graph illustrating a relationship between the sound pressure and the frequency of the woofer including two woofer loudspeaker units with respect to practical example 1 indicated by a solid line and comparative example 1 indicated by a broken line. In FIG. 13, a vertical axis indicates the sound pressure (unit: dB) and a horizontal axis indicates the frequency (unit: Hz).

Figure 14:
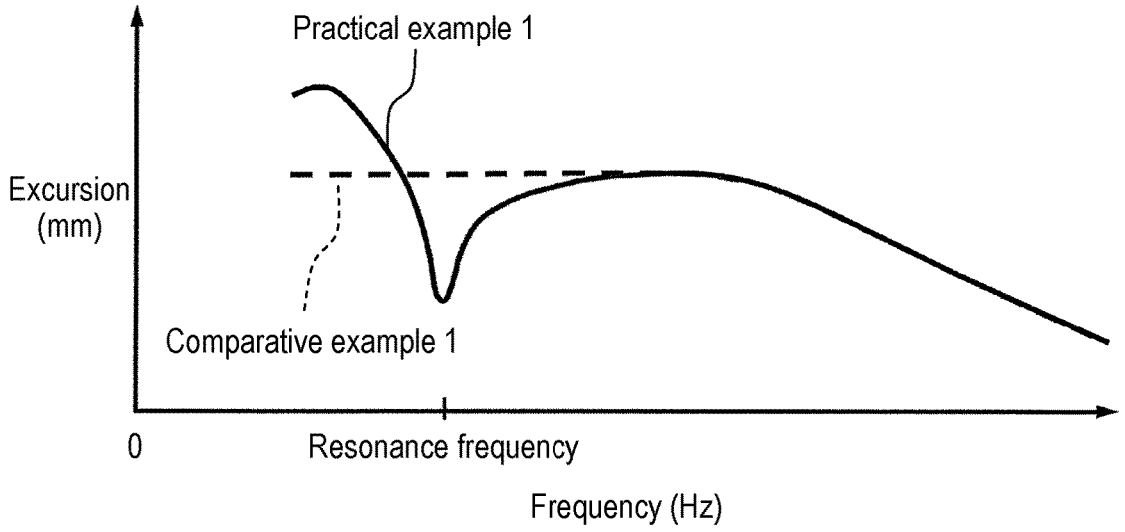
FIG. 14 schematically illustrates an example of a relationship between an excursion and a frequency of a diaphragm of a woofer loudspeaker unit included in the loudspeaker device of the first exemplary embodiment.

FIG. 14 schematically illustrates an example of a relationship between an excursion and a frequency of a diaphragm of a woofer loudspeaker unit included in loudspeaker device 1 of the first exemplary embodiment. FIG. 14 is a graph illustrating a relationship between the excursion and the frequency of the diaphragm of the woofer loudspeaker unit of the woofer with respect to practical example 1 indicated by the solid line and comparative example 1 indicated by the broken line. In FIG. 14, a vertical axis indicates the excursion (unit: mm) and a horizontal axis indicates the frequency (unit: Hz).

Figure 15:
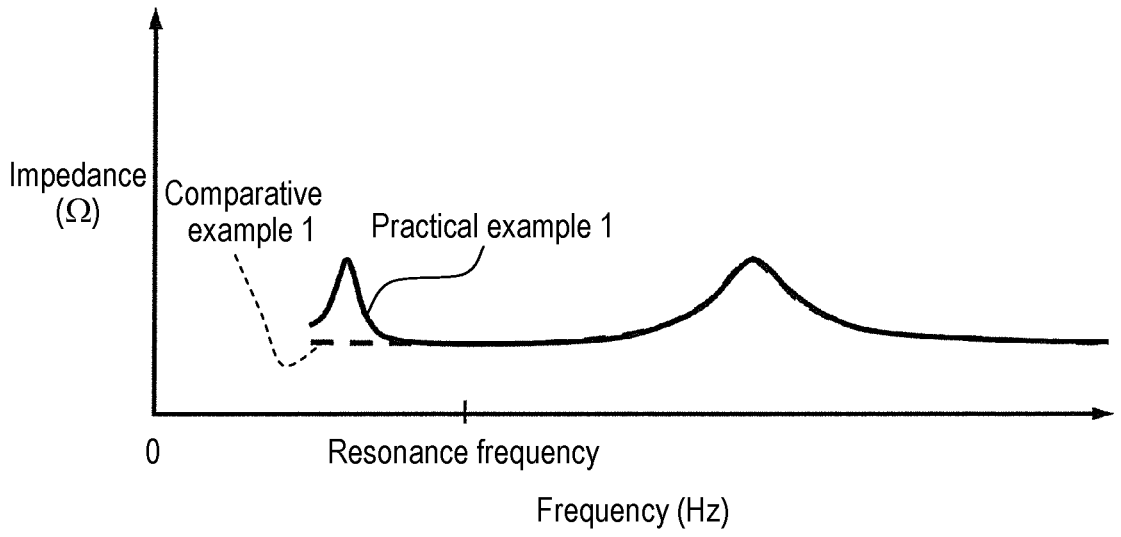
FIG. 15 schematically illustrates an example of a relationship between impedance and a frequency of the woofer loudspeaker unit included in the loudspeaker device of the first exemplary embodiment.

FIG. 15 schematically illustrates an example of a relationship between impedance and a frequency of the woofer loudspeaker unit included in loudspeaker device 1 of the first exemplary embodiment. FIG. 15 is a graph illustrating a relationship between the impedance and the frequency of the woofer loudspeaker unit of the woofer with respect to practical example 1 indicated by the solid line and comparative example 1 indicated by the broken line. In FIG. 15, a vertical axis indicates the impedance (unit: Ω) and a horizontal axis indicates the frequency (unit: Hz).

As illustrated in FIG. 13, compared with comparative example 1, the sound pressure of woofer 60 (low-pitched sound region) in practical example 1 is increased by the influence of the bass reflex resonance in the frequency band near 40 Hz that is the bass reflex resonance frequency.

On the other hand, as illustrated in FIG. 14, compared with comparative example 1, the excursion of the diaphragm of the woofer loudspeaker unit in practical example 1 is largely decreased in the frequency band near 40 Hz that is the bass reflex resonance frequency. Thus, in practical example 1, the excursion of the diaphragm is suppressed in the deep low-pitched sound region near 40 Hz, so that the sound quality and sound reliability can be assured.

As illustrated in FIG. 15, the impedance of the woofer loudspeaker unit in practical example 1 is influenced by a diaphragm speed of the bass reflex resonance, and two peaks are generated in the low frequency band. The impedance of comparative example 1 has only one peak because the loudspeaker housing has the sealed structure and one resonance system. In practical example 1, the bass reflex resonance frequency exists between the two peaks. With decreasing impedance near the bass reflex resonance frequency, the excursion of the diaphragm can be efficiently suppressed to a lower level.

[1-4. Effect and the Like]

As described above, in the first exemplary embodiment, a loudspeaker device includes a loudspeaker housing, a first loudspeaker unit provided in a first wall of the loudspeaker housing, and an acoustic tube communicating an inside and an outside of the loudspeaker housing to each other. The acoustic tube has a predetermined length, and is accommodated in the loudspeaker housing while helically bent.

Loudspeaker device 1 is an example of the loudspeaker device. Loudspeaker housing 31 is an example of the loudspeaker housing. One of upper wall 31*e* and lower wall 31*f* is an example of the first wall. One of upper woofer loudspeaker unit 32 and lower woofer loudspeaker unit 33 is an example of the first loudspeaker unit. Acoustic tube 36 is an example of the acoustic tube.

For example, in the example shown in the first exemplary embodiment, loudspeaker device 1 includes loudspeaker housing 31, upper woofer loudspeaker unit 32 (or lower woofer loudspeaker unit 33) provided in upper wall 31*e* (or lower wall 31*f*) of loudspeaker housing 31, and acoustic tube 36 communicating the inside and outside of loudspeaker housing 31 to each other. Acoustic tube 36 has a predetermined length, and is accommodated in loudspeaker housing 31 while helically bent. Upper woofer loudspeaker unit 32 and lower woofer loudspeaker unit 33 may be mounted on loudspeaker housing 31 so as to face the inside and outside of loudspeaker housing 31.

In loudspeaker device 1 having the above configuration, when upper woofer loudspeaker unit 32 (or lower woofer loudspeaker unit 33) vibrates, gas in loudspeaker housing 31 (that is, the gas in internal space 34) resonates at a specific frequency. In loudspeaker device 1, the sound pressure can be increased near the resonance frequency by the resonance of the gas in loudspeaker housing 31. The resonance frequency of the gas in loudspeaker housing 31 varies depending on the length of acoustic tube 36. In loudspeaker device 1, acoustic tube 36 is accommodated in loudspeaker housing 31 while helically bent, so that acoustic tube 36 can be lengthened compared with the case that the acoustic tube is not helically bent. Accordingly, in loudspeaker device 1, relatively long acoustic tube 36 can be accommodated in loudspeaker housing 31 even if necessity to form acoustic tube 36 relatively long arises in order to set the resonance frequency to a target frequency. Therefore, the excursion of diaphragm 32*a* of upper woofer loudspeaker unit 32 (or the excursion of diaphragm 33*a* of lower woofer loudspeaker unit 33) can be decreased in the deep low-pitched sound region. When acoustic tube 36 is helically formed, acoustic tube 36 can largely and uniformly bent. Therefore, the noise generated in the bent portion of acoustic tube 36 can be suppressed.

In the loudspeaker device, the predetermined length of the acoustic tube may be set such that the frequency of the loudspeaker unit is lower than a predetermined frequency when the gas speed in the acoustic tube is maximized by the resonance of the gas in the loudspeaker housing.

For example, in the example shown in the first exemplary embodiment, in loudspeaker device 1, the predetermined length of acoustic tube 36 is set such that the frequency of upper woofer loudspeaker unit 32 (or lower woofer loudspeaker unit 33) is set lower than the predetermined frequency when the gas speed (gas speed in tube) in acoustic tube 36 is maximized by the resonance of the gas in loudspeaker housing 31.

In loudspeaker device 1, the noise is easily generated when the gas speed (gas speed in tube) in acoustic tube 36 is enhanced. The frequency of upper woofer loudspeaker unit 32 (or lower woofer loudspeaker unit 33) is set lower than the predetermined frequency (for example, the frequency is lowered to a low-pitched sound frequency band hardly including the sound reproducible with upper woofer loudspeaker unit 32 or lower woofer loudspeaker unit 33) when the noise is maximized (that is, the gas speed (gas speed in tube) in acoustic tube 36 is maximized), which allows the large reduction of the noise audible by the user. At this point, for example, the predetermined frequency may be a frequency of the low-pitched sound lower than or equal to the lowest-pitched sound reproducible with upper woofer loudspeaker unit 32 or lower woofer loudspeaker unit 33.

The loudspeaker device may further include a second loudspeaker unit provided in a second wall of the loudspeaker housing, the second wall being disposed opposite to the first wall.

The other of upper wall 31*e* and lower wall 31*f* is an example of the second wall. The other of upper woofer loudspeaker unit 32 and lower woofer loudspeaker unit 33 is an example of the second loudspeaker unit.

For example, in the example shown in the first exemplary embodiment, loudspeaker device 1 includes upper woofer loudspeaker unit 32 provided in upper wall 31*e* of loudspeaker housing 31 and lower woofer loudspeaker unit 33 provided in lower wall 31*f* of loudspeaker housing 31, lower wall 31*f* being disposed opposite to upper wall 31*e*.

In loudspeaker device 1 having the above configuration, when the plurality of woofer loudspeaker units (upper woofer loudspeaker unit 32 and lower woofer loudspeaker unit 33) are provided, the sound can be reproduced with the high sound pressure even if those woofer loudspeaker units are small.

In the loudspeaker device, the acoustic tube may be disposed between the first loudspeaker unit and the second loudspeaker unit, which are disposed opposite to each other.

For example, in the example shown in the first exemplary embodiment, in loudspeaker device 1, acoustic tube 36 is disposed between upper woofer loudspeaker unit 32 and lower woofer loudspeaker unit 33, which are disposed opposite to each other (that is, disposed while oriented toward the directions opposite to each other).

In loudspeaker device 1 having the above configuration, acoustic tube 36 can suppress the interference between the vibration waves generated with diaphragm 32*a* of upper woofer loudspeaker unit 32 and diaphragm 33*a* of lower woofer loudspeaker unit 33, which are disposed opposite to each other, and acoustic tube 36 can suppress the generation of the standing wave caused by the interference between the vibration waves. Accordingly, the influence of the standing wave on the resonance of the gas in loudspeaker housing 31 can be suppressed in loudspeaker device 1.

In the loudspeaker device, at least part of at least one of the first loudspeaker unit and second loudspeaker unit may be disposed inside a helix of the acoustic tube.

For example, in the example shown in the first exemplary embodiment, in loudspeaker device 1, a part of upper woofer loudspeaker unit 32 and a part of lower woofer loudspeaker unit 33 are disposed inside the helix of acoustic tube 36.

In loudspeaker device 1 having the above configuration, a distance between upper woofer loudspeaker unit 32 and lower woofer loudspeaker unit 33 can be reduced. Therefore, loudspeaker housing 31 can be miniaturized in the direction (Z-axis direction) from upper wall 31*e* toward lower wall 31*f*. In loudspeaker device 1, upper woofer loudspeaker unit 32 and lower woofer loudspeaker unit 33 may wholly be disposed inside the helix of acoustic tube 36.

In the loudspeaker device, the acoustic tube may extend helically so as to come close to a sidewall of the loudspeaker housing, the sidewall being formed between the first wall and a second wall of the loudspeaker housing, the second wall being disposed opposite to the first wall.

Each of sidewalls 31*a*, 31*b*, 31*c*, and 31*d* is an example of the sidewall.

For example, in the example shown in the first exemplary embodiment, in loudspeaker device 1, acoustic tube 36 extends helically so as to come close to each of sidewalls 31*a*, 31*b*, 31*c*, and 31*d* of the loudspeaker housing, sidewalls 31*a*, 31*b*, 31*c*, and 31*d* being formed between upper wall 31*e* and lower wall 31*f*.

In loudspeaker device 1 having the above configuration, a diameter of the helix of acoustic tube 36 can relatively be increased. Therefore, in loudspeaker device 1, the bending diameter of acoustic tube 36 is relatively increased, and the bending relatively becomes loose, which allows the suppression of the noise generated in the bent portion of acoustic tube 36.

The loudspeaker device may further include a boost controller that controls the loudspeaker unit such that a sound pressure of the loudspeaker unit is increased when a frequency of the loudspeaker unit exists at a resonance frequency of gas in the loudspeaker housing and in a frequency band near the resonance frequency.

Circuit board 52 (or the circuit mounted on circuit board 52) is an example of the boost controller.

For example, in the example shown in the first exemplary embodiment, loudspeaker device 1 includes circuit board 52 on which the circuit is mounted, the circuit performing the boost control on upper woofer loudspeaker unit 32 and lower woofer loudspeaker unit 33 in order to increase the sound pressures of upper woofer loudspeaker unit 32 and lower woofer loudspeaker unit 33 when the frequencies of upper woofer loudspeaker unit 32 and lower woofer loudspeaker unit 33 exist at the resonance frequency of the gas in loudspeaker housing 31 or in the frequency band near resonance frequency.

In loudspeaker device 1, the excursions of diaphragm 32*a* of upper woofer loudspeaker unit 32 and diaphragm 33*a* of lower woofer loudspeaker unit 33 are decreased when the frequencies of upper woofer loudspeaker unit 32 and lower woofer loudspeaker unit 33 exist at the resonance frequency or in the frequency band near resonance frequency. However, in loudspeaker device 1, the sound pressure in the frequency band, in which the excursions of diaphragm 32*a* and 33*a* are decreased, is increased by the boost control, so that the sound quality can be assured after the sound-pressure increase performed by the boost control.

The loudspeaker device may further include a diffuser body. The diffuser body is provided at a position facing the first loudspeaker unit on the outside of the loudspeaker housing, and diffuses, in a predetermined direction, sound output from the first loudspeaker unit.

Each of diffuser body 22 and diffuser body 42 is an example of the diffuser body.

For example, in the example shown in the first exemplary embodiment, loudspeaker device 1 includes diffuser body 22, which is provided at the position facing upper woofer loudspeaker unit 32 on the outside of loudspeaker housing 31 and diffuses, in a predetermined direction, the sound output from upper woofer loudspeaker unit 32. Loudspeaker device 1 also includes diffuser body 42, which is provided at the position facing lower woofer loudspeaker unit 33 on the outside of loudspeaker housing 31 and diffuses, in a predetermined direction, the sound output from lower woofer loudspeaker unit 33.

In loudspeaker device 1 having the above configuration, the sound reproduced with upper woofer loudspeaker unit 32 can widely be diffused in the predetermined direction, and the sound reproduced with lower woofer loudspeaker unit 33 can widely be diffused in the predetermined direction. Accordingly, loudspeaker device 1 can spread the directional ranges of the sounds reproduced with upper woofer loudspeaker unit 32 and lower woofer loudspeaker unit 33. Diffuser body 22 or diffuser body 42 may diffuse the sound emitted from upper woofer loudspeaker unit 32 or lower woofer loudspeaker unit 33 while changing the direction of the sound by way that the sound collides with diffuser body 22 or diffuser body 42.

In the loudspeaker device, the predetermined direction may be a direction over 360 degrees in a horizontal direction about the loudspeaker device when the loudspeaker device is mounted such that the first wall is located in an upper portion or a lower portion of the loudspeaker housing.

For example, in the example shown in the first exemplary embodiment, in loudspeaker device 1, the direction (predetermined direction) in which diffuser body 22 and diffuser body 42 diffuse the sounds is the direction over 360 degrees in the horizontal direction about loudspeaker device 1 when loudspeaker device 1 is mounted (that is, loudspeaker device 1 is mounted on the mounting surface parallel to the horizontal plane) such that upper wall 31*e* (or lower wall 310 is located in the upper portion (or the lower portion) of loudspeaker housing 31.

In loudspeaker device 1 having the above configuration, the sounds reproduced with upper woofer loudspeaker unit 32 and lower woofer loudspeaker unit 33 are diffused in the wide range over the whole periphery of loudspeaker device 1.

Loudspeaker device 1 of the first exemplary embodiment includes the plurality of tweeter units 12 and the plurality of directional control horns 13 mounted in the plurality of tweeter units 12, respectively. Each of the plurality of directional control horns 13 restricts the spread of the sound output from tweeter unit 12 to the predetermined range. Directional control horns 13 adjacent to each other are disposed such that the directional ranges of directional control horns 13 do not substantially overlap each other. In loudspeaker device 1 having the above configuration, the sounds reproduced with the plurality of tweeter units 12 are diffused over the plurality of directional ranges using the plurality of directional control horns 13. In loudspeaker device 1, the interference between the sounds emitted from the plurality of directional control horns 13 oriented toward different directions is suppressed. The sound reproduced with each tweeter unit 12 is emitted while the sound pressure is kept constant in the wide range, because directional control horn 13 restricts the directional range of the sound, respectively. Accordingly, the sounds emitted from the plurality of directional control horns 13 are widely diffused while a disturbance is suppressed. This enables the user to listen to the sound reproduced with tweeter unit 12 with a little change in sound quality at a listening position in the relatively wide range.

In loudspeaker device 1 of the first exemplary embodiment, each of directional control horns 13 is disposed such that the directional ranges of directional control horns 13 are adjacent to one another in the substantially horizontal direction. In loudspeaker device 1 having the above configuration, the sounds can widely be diffused in the horizontal direction with the plurality of directional control horns 13. Accordingly, in loudspeaker device 1, the directional characteristic, in horizontal direction, of the sound reproduced with tweeter unit 12 can be reduced.

Loudspeaker device 1 of the first exemplary embodiment includes tweeter 10 and woofer 60 while tweeter 10 and woofer 60 are integrated. In loudspeaker device 1, each of upper woofer loudspeaker unit 32 and lower woofer loudspeaker unit 33 of loudspeaker housing 31 is configured to improve the sound quality in the deep low-pitched sound region, and tweeter unit 12 including directional control horn 13 is configured to improve the sound quality in the high-pitched sound region, which allows the sound quality of the reproduced sound to be improved from the deep low-pitched sound region to the high-pitched sound region.

Other Exemplary Embodiments

The first exemplary embodiment has been described above as an illustration of the technology of the present disclosure. However, the technology of the present disclosure is not limited to the first exemplary embodiment, and can also be applied to embodiments in which various changes, replacements, additions, and omissions can be made. Furthermore, a new exemplary embodiment can also be made by a combination of the first exemplary embodiment and each component described in the following exemplary embodiments.

Other exemplary embodiments will be described below.

The first exemplary embodiment has described a configuration example in which, in loudspeaker device 1, woofer loudspeaker 30 includes the two woofer loudspeaker units, namely, upper woofer loudspeaker unit 32 and lower woofer loudspeaker unit 33. However, the present disclosure is not limited to the configuration example of the first exemplary embodiment. Alternatively, woofer loudspeaker 30 may include one or at least three woofer loudspeaker units.

The first exemplary embodiment has described a configuration example in which, in loudspeaker device 1, acoustic tube 36 included in woofer loudspeaker 30 is formed into a smoothly curved helix shape having the circular section. However, the present disclosure is not limited to the configuration example of the first exemplary embodiment. Alternatively, acoustic tube 36 may have a predetermined length of the tube and a predetermined sectional area of the tube. The sectional shape of acoustic tube 36 is not limited to the circular shape, but may be a polygonal shape such as a rectangle, or an ellipse or an oval. The shape of acoustic tube 36 is not limited to the helix shape, but may be any shape as long as acoustic tube 36 can be accommodated in internal space 34. In the case that acoustic tube 36 has the bent shape, for example, acoustic tube 36 may have a spiral shape, a shape in which the tube reciprocates in the Z-axis direction in internal space 34, a shape in which the tube reciprocates in the X-axis or Y-axis direction, or a combination thereof.

The first exemplary embodiment has described a configuration example in which, in loudspeaker device 1, whole acoustic tube 36 of woofer loudspeaker 30 is included in internal space 34 of loudspeaker housing 31. However, the present disclosure is not limited to the configuration example of the first exemplary embodiment. Alternatively, acoustic tube 36 may extend partially to the outside of loudspeaker housing 31.

The first exemplary embodiment has described a configuration example in which, in loudspeaker device 1, tweeter 10 includes the three sets of tweeter unit 12 and directional control horn 13. However, the present disclosure is not limited to the configuration example of the first exemplary embodiment. Alternatively, tweeter 10 may include two or four sets of tweeter unit 12 and directional control horn 13. For example, in the configuration example in which tweeter 10 includes the four sets of tweeter unit 12 and directional control horn 13, tweeter 10 can substantially nondirectionally reproduce the sound over 360 degrees in the horizontal direction around loudspeaker device 1. In the configuration example in which tweeter 10 includes the two sets of tweeter unit 12 and directional control horn 13, the nondirectional sound can widely be reproduced by the change in directional angle of directional control horn 13.

The first exemplary embodiment has described a configuration example in which, in loudspeaker device 1, tweeter 10 includes the three directional control horns 13 having the directional angle of 90 degrees.

However, the present disclosure is not limited to the configuration example of the first exemplary embodiment. Directional control horn 13 may have the directional angle except for 90 degrees. The first exemplary embodiment has described a configuration example in which tweeter units 12 are disposed while oriented at right angles to each other, otherwise directional control horn 13 may have the directional angle except for 90 degrees. The plurality of directional control horns 13 may differ from each other in the directional angle.

The first exemplary embodiment has described a configuration example in which, in tweeter 10 of loudspeaker device 1, three directional control horns 13 are disposed such that central axis 13*gc* of each directional control horn 13 is set along the XY-plane. However, the present disclosure is not limited to the configuration example of the first exemplary embodiment. In tweeter 10, central axis 13*gc* of directional control horn 13 may be set along any plane.

The first exemplary embodiment has described a configuration example in which, in loudspeaker device 1, tweeter 10 is disposed on woofer 60. However, the present disclosure is not limited to the configuration example of the first exemplary embodiment. The disposition form and disposition order of woofer 60 and tweeter 10 may be set anyway.

The first exemplary embodiment has described a configuration example in which, in woofer 60 of loudspeaker device 1, upper woofer loudspeaker unit 32 and lower woofer loudspeaker unit 33 are vertically disposed. However, the present disclosure is not limited to the configuration example of the first exemplary embodiment. Woofer 60 may be disposed in any direction.

The first exemplary embodiment has described a configuration example in which loudspeaker device 1 includes tweeter 10 and woofer 60 while tweeter 10 and woofer 60 are integrated. However, the present disclosure is not limited to the configuration example of the first exemplary embodiment. Loudspeaker device 1 may be configured to include only one of tweeter 10 and woofer 60.

Figure 16:
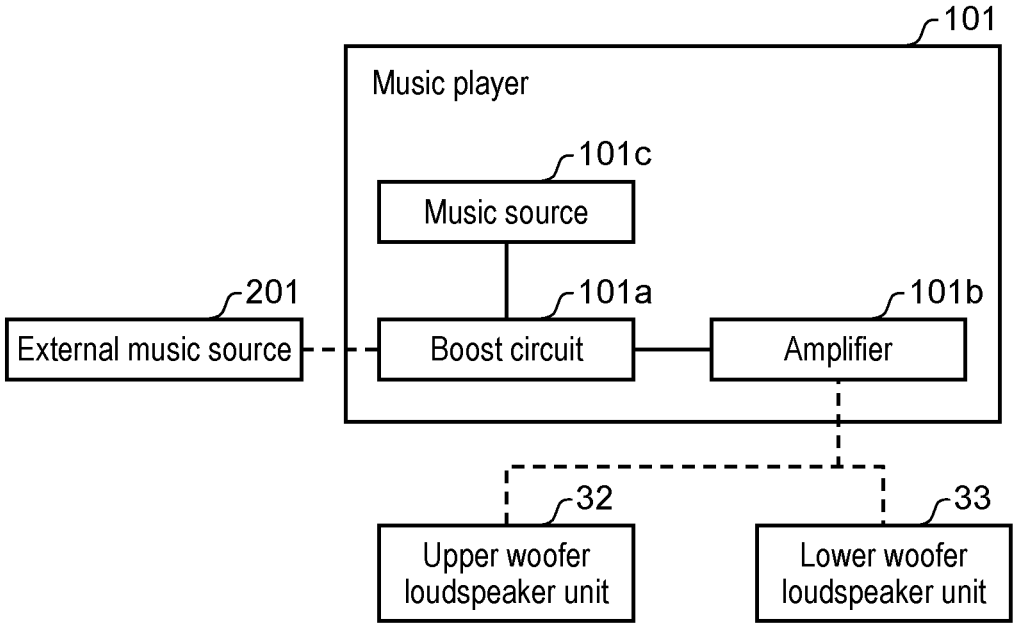
FIG. 16 is a block diagram illustrating a configuration example of components associated with boost control of the woofer loudspeaker unit included in the loudspeaker device of the first exemplary embodiment.

The first exemplary embodiment has described a configuration example in which, in loudspeaker device 1, the circuit mounted on circuit board 52 (see FIG. 10) performs the control (boost control) in which upper woofer loudspeaker unit 32 and lower woofer loudspeaker unit 33 are boosted to increase the sound pressure. However, the present disclosure is not limited to the configuration example of the first exemplary embodiment. An external device of loudspeaker device 1 may perform the boost control on upper woofer loudspeaker unit 32 and lower woofer loudspeaker unit 33. For example, music player 101 may perform the boost control on upper woofer loudspeaker unit 32 and lower woofer loudspeaker unit 33. FIG. 16 illustrates a configuration example in this case.

FIG. 16 is a block diagram illustrating the configuration example of components associated with the boost control of the woofer loudspeaker unit included in loudspeaker device 1 of the first exemplary embodiment. In the case that music player 101 performs the boost control on upper woofer loudspeaker unit 32 and lower woofer loudspeaker unit 33, music player 101 includes boost circuit 101*a* that performs the boost control and amplifier 101*b* as illustrated in the block diagram in FIG. 16. Boost circuit 101*a* boosts a signal received from music source 101*c*, such as a CD player or the radio, which is included in music player 101 or external music source 201, such as an external device, with which music player 101 communicates. Amplifier 101*b* amplifies the boosted signal, and transmits the signal to upper woofer loudspeaker unit 32 and lower woofer loudspeaker unit 33 of loudspeaker device 1. Acoustic system 100 including loudspeaker device 1 may be configured in this manner. At this point, the circuit mounted on circuit board 52 may not have the function of controlling upper woofer loudspeaker unit 32 and lower woofer loudspeaker unit 33. Circuit board 52 may be configured to act only as a relay board relaying electrical connection of a signal line (lead) connected from music player 101 to loudspeaker device 1 and upper woofer loudspeaker unit 32 and lower woofer loudspeaker unit 33. Circuit board 52 may relay the electrical connection of the lead connected from music player 101 to loudspeaker device 1 and tweeter unit 12.

The first exemplary embodiment has described a configuration example in which, in loudspeaker device 1, the circuit mounted on tweeter circuit board 14 (see FIG. 12) of tweeter 10 controls tweeter unit 12. However, the present disclosure is not limited to the configuration example of the first exemplary embodiment. Alternatively, an external device of loudspeaker device 1 may control tweeter unit 12. For example, music player 101 may control tweeter unit 12. At this point, tweeter circuit board 14 may be configured to act only as a relay board relaying electrical connection of the lead connected from music player 101 to loudspeaker device 1 or the lead extending from music player 101 through circuit board 52 of pedestal housing 51 and tweeter unit 12.

In the first exemplary embodiment, the term "the frequency of the loudspeaker unit" is used. This means "the frequency of the sound currently reproduced with the loudspeaker unit" or "the frequency of the sound reproduced with the loudspeaker unit".

The above exemplary embodiments are described as an illustration of the technology of the present disclosure. The accompanying drawings and the detailed description are made for this end.

Accordingly the components illustrated or described in the accompanying drawings and detailed description includes not only the components necessary for solving the problem but also the components unnecessary for solving the problem in order to illustrate the technique. It is noted that the unnecessary components are not immediately recognized as the necessary components even if the unnecessary components are illustrated or described in the accompanying drawings or detailed description.

The above exemplary embodiments are intended to illustrate the technology in the present disclosure, and various changes, replacements, additions, omissions, and the like may be made within the scope of the claims or equivalents thereof.

INDUSTRIAL APPLICABILITY

The present disclosure can be applied to a loudspeaker device and an instrument including the loudspeaker device. Specifically, the present disclosure can be applied to various instruments, which include the loudspeaker devices, such as an acoustic system including a music player, an audio and video system including a monitor such as a television, and a personal computer.

REFERENCE MARKS IN THE DRAWINGS

1 loudspeaker device
1*a* side face (front face)
1*b*, 1*c* side face
1*d* side face (rear face)
1*e* top face
1*f* bottom face
2 exterior net
3 top board
10 tweeter
11 tweeter frame
11*a* upper edge
11*b* support
11*c* rear face wall
12 tweeter unit
13 directional control horn
13*a*, 13*b* sidewall
13*aa*, 13*ba* bent portion
13*c* upper wall
13*d* bottom wall
13*e*, 13*f* opening
14 tweeter circuit board
20 upper diffuser
21 upper frame
21*a* support
21*b* support plate
22, 42 diffuser body
22*a*, 42*a* diffusion part
30 woofer loudspeaker
31 loudspeaker housing
31*a*, 31*b*, 31*c*, 31*d* sidewall
31*e* upper wall
31*f* lower wall
32 upper woofer loudspeaker unit
32*a*, 33*a* diaphragm
33 lower woofer loudspeaker unit
34 internal space
35 acoustic port
35*a* port plate
36 acoustic tube
36*a* flange
36*b* end
37 sound absorbing material
40 lower diffuser
41 lower frame
41*a* support
41*b* beam
50 pedestal
51 pedestal housing
52 circuit board
60 woofer
100 acoustic system
101 music player
101*a* boost circuit
110 operating part
101*b* amplifier
101*c* music source
121 first tweeter unit
122 second tweeter unit
123 third tweeter unit
131 first directional control horn
132 second directional control horn
133 third directional control horn
201 external music source
A directional range
C diffusion reference point
L1, L2 line segment

The invention claimed is:

1. A loudspeaker device comprising:
a loudspeaker housing;
a first loudspeaker unit provided in a first wall of the loudspeaker housing; and
an acoustic tube communicating an inside and an outside of the loudspeaker housing to each other; and
a second loudspeaker unit provided in a second wall of the loudspeaker housing, the second wall being disposed opposite to the first wall,
wherein the acoustic tube has a predetermined length, and is accommodated in the loudspeaker housing, the acoustic tube is helically shaped and void of corners, and
the acoustic tube is disposed between a diaphragm of the first loudspeaker unit and a diaphragm of the second loudspeaker unit, the first loudspeaker unit and the second loudspeaker unit being disposed opposite to each other.

2. The loudspeaker device according to claim 1, wherein at least part of at least one of the first loudspeaker unit and the second loudspeaker unit is disposed inside a helix of the acoustic tube.

3. The loudspeaker device according to claim 1, wherein the acoustic tube extends helically so as to come close to a sidewall of the loudspeaker housing, the sidewall being formed between the first wall and a second wall of the loudspeaker housing, the second wall being disposed opposite to the first wall.

4. The loudspeaker device according to claim 1, further comprising a diffuser body diffusing, in a predetermined direction, sound output from the first loudspeaker unit, the diffuser body being provided at a position facing the first loudspeaker unit on the outside of the loudspeaker housing.

5. The loudspeaker device according to claim 4, wherein the predetermined direction is a direction over 360 degrees in a horizontal direction about the loudspeaker device when the loudspeaker device is mounted such that the first wall is located in an upper portion or a lower portion of the loudspeaker housing.

6. The loudspeaker device according to claim 1, wherein the predetermined length of the acoustic tube is set such that a frequency of the loudspeaker unit is lower than a predetermined frequency when a gas speed in the acoustic tube is maximized by resonance of gas in the loudspeaker housing.

7. The loudspeaker device according to claim 1, further comprising a boost controller controlling the loudspeaker unit such that a sound pressure of the loudspeaker unit is increased when a frequency of the loudspeaker unit exists at a resonance frequency of gas in the loudspeaker housing and in a frequency band near the resonance frequency.

8. The loudspeaker device according to claim 1, wherein the acoustic tube is formed into a helical shape having a coil spring shape which is provided a gap of a predetermined interval, sectional shape of the acoustic tube other than one end and another end is a circular shape or an ellipse shape.

9. A loudspeaker device comprising:

a loudspeaker housing;

a first loudspeaker unit provided in a first wall of the loudspeaker housing; an acoustic tube communicating an inside and an outside of the loudspeaker housing to each other; and a second loudspeaker unit provided in a second wall of the loudspeaker housing, the second wall being disposed opposite to the first wall, wherein the acoustic tube has a predetermined length and a circular cross-section, and is accommodated in the loudspeaker housing, the acoustic tube is helically shaped and void of corners, and a part of the first loudspeaker unit and the second loudspeaker unit are disposed inside a helix of the acoustic tube.

* * * * *